US011511831B1

(12) United States Patent
Krah et al.

(10) Patent No.: US 11,511,831 B1
(45) Date of Patent: Nov. 29, 2022

(54) HUMAN POWERED WATERCRAFT

(71) Applicants: Drew Allen Krah, Vashon, WA (US); Maya Jane Krah, Vashon, WA (US); Glen Edward Krah, Vashon, WA (US)

(72) Inventors: Drew Allen Krah, Vashon, WA (US); Maya Jane Krah, Vashon, WA (US); Glen Edward Krah, Vashon, WA (US)

( * ) Notice: Subject to any disclaimer, the term of this patent is extended or adjusted under 35 U.S.C. 154(b) by 0 days.

(21) Appl. No.: 16/602,466

(22) Filed: Oct. 12, 2019

Related U.S. Application Data

(60) Provisional application No. 62/918,761, filed on Feb. 11, 2019, provisional application No. 62/766,501, filed on Oct. 22, 2018.

(51) Int. Cl.
*B63B 32/60* (2020.01)
*B63B 32/57* (2020.01)

(52) U.S. Cl.
CPC ..... *B63B 32/60* (2020.02); *B63B 32/57* (2020.02)

(58) Field of Classification Search
CPC .... B64C 3/00; B64C 3/10; B64C 3/14; B64C 31/00; B64C 3/26; B64D 3/00; B64D 3/02; B63B 32/60; B63B 32/57
See application file for complete search history.

(56) References Cited

U.S. PATENT DOCUMENTS

| | | | | |
|---|---|---|---|---|
| 4,898,345 | A * | 2/1990 | Clayton | B64C 31/00 114/272 |
| 5,429,536 | A * | 7/1995 | Evans | A63B 31/11 441/64 |
| 6,099,369 | A | 8/2000 | Puzey | |
| 6,102,760 | A * | 8/2000 | Seigler | B63B 34/54 441/65 |
| 2014/0378013 | A1 | 12/2014 | Palairet | |
| 2015/0266573 | A1* | 9/2015 | Wypyszynski | B64C 39/026 244/1 TD |
| 2016/0332706 | A1* | 11/2016 | Martens | B63B 32/57 |

OTHER PUBLICATIONS

Schuck, Dr. Julius, "Wasserlaufer;" YouTube link https://www.youtube.com/watch?v=TwgCUeMY17c.

* cited by examiner

*Primary Examiner* — Anthony D Wiest
(74) *Attorney, Agent, or Firm* — Lowe Graham Jones PLLC

(57) ABSTRACT

A wing, buoyant in water has an upper wing surface comprising a deck upon which a rider stands, and, the wing is in water. A foot constraint proximate the wing leading edge and fixedly attaching the wing projects outwardly from the deck to release-ably receive the rider's forward foot. With the rider standing with both feet upon the deck, and the rider's forward foot ensconced within the foot constraint, and with the rider's aft foot proximate a trailing edge of the wing, the rider bodily heaves and pitches the wing to obtain a chordwise forward velocity thru the water. The forward foot constraint enables the rider to upheave the wing. A second foot constraint may attach the deck proximate the wing trailing edge. Another foot constraining system is comprised as a frictional device broadly applying the deck, and, may be used in addition to or in lieu of other constraints.

20 Claims, 20 Drawing Sheets

HUMAN POWERED WATERCRAFT

CROSS REFERENCE TO RELATED APPLICATIONS

Figure 1A:
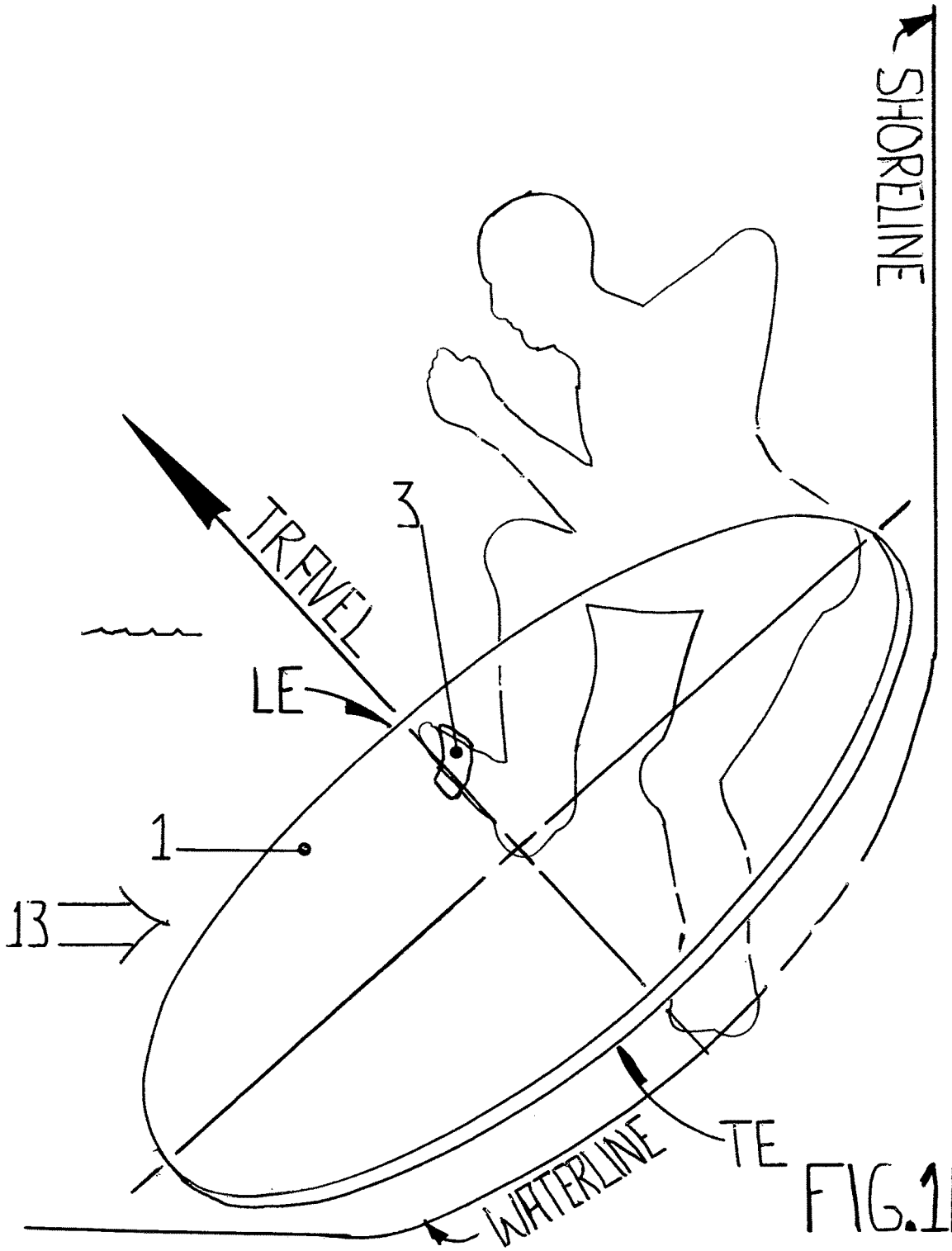

This application claims the benefit of Provisional Patent Application 62/766,501 having a filing date of Oct. 22, 2018, by inventors Maya Jane Krah, Drew Allen Krah, and Glen Edward Krah, titled HUMAN POWERED WATERCRAFT, the entire contents of which are incorporated herein in full, and, further claims the benefit of Provisional Patent Application 62/918,761 having a filing date of Feb. 11, 2019, by inventors Maya Jane Krah, Drew Allen Krah, and Glen Edward Krah, titled HUMAN POWERED WATERCRAFT, the entire contents of which are incorporated herein in full.

FEDERALLY SPONSORED RESEARCH

None.

SEQUENCE LISTING

None.

BACKGROUND OF THE INVENTION

Surfboards, skim boards, body-boards, swim-boards, and stand-up paddle-boards are great fun in ocean swells and waves, not so upon flat seas. Watercraft such as Trampofoil, by Sahlin of Sweden, and derivative hydrofoil watercraft by Puzey, and by Chen are operable in flat seas and marginally in small wave conditions, but, these hydrofoil vessels by Sahlin, Puzey, and Chen are expensive, complex, and ungainly in self-rescue mode, having little or no floatation and these same watercraft are unable to water start when they are in deep-water and are stopped. Though they (Sahlin, Puzey, and Chen) can fly, their lack of floatation, and the inability to lay upon the hydrofoils to prone-paddle for self-rescue to return to land extremely limits their seaworthiness.

Although conventional surfboards, skim-boards, body boards, swim boards, and stand-up paddle-boards can plane across wave faces and, in the case of skim boards, skim atop thin films of water, they cannot fly whilst submerged in the water by human power.

In the last several years, conventional surfboards, body-boards, swim boards, and stand-up paddle-boards, though not skim boards, have undergone some innovation in the form of added hydrofoils of smallish size connected to the boards by stanchions, these combination boards tend to yield performance which is marginal when in flight mode and sub-marginal in planing mode, and, they are cumbersome and clumsy during portage in addition to being expensive for the consumer to purchase. Lastly, hydrofoil type surfboards and kiteboards, and tricycle type hydrofoils pose very great danger of impalement causing frequent injury to users and by-standers.

Therefore, that which conventional surfboards and the like lack, and that which Sahlin-type hydrofoils in their own fashion lack, and also, the unique lacking of hydrofoil type surfboards, that is to say, the overlapping failings of all three of these afore-mentioned watercraft, be it inability to fly of some, be it lack of seaworthiness, be it un-gainliness, be it cumbersomeness in self-fescue, be it difficulty in portaging, be it lack of floatation, be it cost, be it fragility, be it the dangers of impalement to users and standers-by, all deficiencies need to be solved simply, conveniently, and economically for the benefit of all watermen and women.

BACKGROUND—DESCRIPTION OF THE RELATED ART

Ketterman—U.S. Pat. No. 602,249: A kayak with a pair of pedal driven flappers. Successful despite high consumer cost and unwieldiness during portage, the vessel is also heavy.

Elkington—U.S. Pat. No. 894,440B2: A rider-controlled skim board comprised as a skim board and pivotal handlebar. During riding, if the nose of the skim board digs into the sand bottom, the rider is catapulted forward colliding with the handlebar, causing impact and possibly injury.

Smith—U.S. Pat. No. 881,113B2: A foot operated hydrofoil for swimmers and divers emphasizing the efficiency of the dolphin stroke with a high-aspect ratio wing. Some apnea diving records have been set both national and world, but the device has a tendency to become hung-up in thick forests of sea kelp, and has not achieved wide market acceptance.

Langenfeld—U.S. Pat. No. 7,988,508B2: Similar to Calvin Gongwer's history making Aqueon propulsion system for swimmers and divers, consisting of a forward propelling fin and an aft stabilizing fin actuated by knee genuflection of the diver causing the propelling fin to oscillate up and down which is to say toward and away from the mid-section of the diver. Market acceptance of the Aqueon and, also the Langenfeld device has been meager.

Langelaan—US2017/0283015A1: A battery powered motor-driving propeller hydrofoil, the hydrofoil attached a floatation device via a long stanchion. The system cannot be water started by human power alone, and the complexity of the device drives an absurdly high consumer cost which precludes acceptance by the mass-consumer market. Furthermore, this and all other board-stanchion-hydrofoils substantially isolate the user from the sea state they are navigating thru by elevating them above the surface of the sea while at the same time imposing upon the user the need to balance precariously above the foil, which in failing to maintain balance risks severe injury even death by impalement from the overturned foil.

Aguera—U.S. Pat. No. 9,789,935B1: A stand-up paddle board with a hydrofoil attached via a long stanchion to the bottom of the board, for hydrofoil surfing with the board out of the water and for down-winder paddling also. Clumsy in the water and especially during portaging, the complexity and, high expense for the device limits market acceptance. The risk of injury or death due to impalement by the foil in the event of loss of balance by the user is serious.

Krah—U.S. Pat. No. 8,043,134B2: A hydrofoil powered watercraft by this inventor using a series of rocker arms to actuate hydrofoil fins to power the vehicle forward. The device was too complex, and found no acceptance in the market.

Krah—U.S. Pat. No. 7,736,205B2: A hydrofoil powered submersible watercraft by this inventor. The device was too complex, and found no acceptance in the market.

Krah—U.S. Pat. No. 7,232,350B1: A hydrofoil powered surfboard by this inventor. The device was too complex, and found no acceptance in the market.

Sahlin—(SW98-0088): Trampofoil: A tricycle configured duel hydrofoil with a large main foil aft, and a small pitch-controlling foil forward, the system is propelled by bounding upon a foot platform which is out of the water whilst in flight. The system is large, expensive and cannot be water-started by human power alone. In the event one falls out of flight, one must side-stroke swim back to land with the device in tow.

Momot—U.S. Pat. No. 4,968,237: A surfboard with a pivoted stepping device actuating an aft whale-tail, was slow and inefficient, achieving no success in the market.

Shuck, Dr. Julius: "Wasserlaufer"; Two high-aspect ratio hydrofoils linked via bars and pivots to step-walk the user across the water at walking speeds. The user has one foot supported above a forward foil and one foot supported above an aft foil. The system is large, complex and fragile, with no known acceptance in the market.

Mcready—U.S. Pat. No. 6,408,118: A hydrofoil catamaran with a forward foil and an aft foil propelled by the rider hopping and gliding. An early demonstrator of human powered hydrofoils, with no attempt to market the device, it was heavy and could not be operated in flight mode for more than several seconds to at most a minute or two before complete exhaustion of the rider.

Puzey—U.S. Pat. No. 6,099,369: "Pump-a-bike", similar to "Trampofoil" having an added floatation body above the tricycle hydrofoil. The system cannot be water-started, and must be swum back shoreward if one falls out of flight.

Bateman—U.S. Pat. No. 5,062,378: A surfboard with forward and aft hydrofoils affixed and projecting below the surfboard hull, the device and all subsequent hydrofoil wakeboards, hydrofoil surfboards, and such require external power sources and even tow vehicles with crew in order to be used. The device achieved no success in the market.

Palairet—US20140378013-Abandoned: A water board having handles and rubber grip pads for the feet, the water board is made of 3-dimensional space frame construction, with or without end-fences, and in some cases, hand tethers. The complexity of construction adds weight, cost, and drag, and, for standing propulsion, the device cannot be upheaved when it has no hand-tethers, while the device with hand tethers is unforgiving in the required coordination, tending to exhaust and frustrate a user after few failed attempts at standing propulsion. Further, the disclosure is vague and ambiguous, discloses no foot-constraining device, the application abandoned.

The limitations of the preceding art show the need for a watercraft of simplicity, and, convenient and small size, and, small cost which is operable by the user as a human powered watercraft individually and unassisted, upon flat waters and in seas having waves, for recreation, fitness, and, for self-rescue.

Objects and Advantages

Irreducible in simplicity, and vastly simpler than the related art, the buoyant wing combined with only a single leading-edge foot constraint makes this human powered watercraft up-heave-able when submerged and thereby easy and safe to learn to propel and operate via the bodily heave-and-pitch exertions of the rider. Absent the leading-edge foot-constraining device, the wing cannot be upheaved from a depth below the surface of the water, and, the absence of an aft-ward foot-constraining device un-obviously simplifies the rider's transition from beach-starting to continuous heave-and-pitch flight of the wing.

Entry, egress, and re-entry are simple and fast since the device has no gunwales and no hard projections outward from the deck. The leading-edge foot-constraining device easily receives the user foot, and upon a fall of the user, easily releases the foot.

Embodiments having larger wingspans of say 5 feet to 10 feet, more-or-less, and chord widths of about 2 feet have wings areas which make water-borne flight easily sustainable at low speeds by athletes and leisure seekers; smaller wing sizes work well for lighter athletes as larger wing sizes work well for heavier athletes.

Embodiments having chord-widths of about a user's shoulder width enable the device to be paddled from a prone laying position both for recreation and to self-rescue.

Embodiments having chord-widths of about a user's shoulder width enable the device to be foot-launched from land into the sea with a powerful rear leg thrust to immediately achieve flight speed in water.

The foot-constraining device of the invention typically a foot strap or an upper of a sandal, positioned such that the forward foot of the rider spans from a leading edge of the wing to a mid-chord position of the wing and thus enabling deft control of the wing in down-heave/down-pitch, also allows free wing pitch-up during up-heave by the user.

The lack of any moving part and the minimally sized structural elements of the device enable manufacturer's cost to be low and likewise for the consumer.

Fitness benefits are achieved by the user who unlike a surfer can practice in flat waters.

Due to the ability to stay constantly in motion, the user is less likely to attract the attention of predatory denizens of the deep, but, if a shark is detected, the user can quickly leave the scene and return to the shore at speeds approaching ten miles per hour.

Can conveniently stow under-arm and is light and easily carried.

Multi-modal: Can be propelled from a standing position by heave and pitching, and can also be laid upon to prone-paddle for self-rescue and for recreation.

Easily fabricated by the home artisan using simple hand tools.

Acutely maneuverable and can be used for wave riding in addition to training upon flat seas.

Standing while propelling in heave-and-pitch, the rider has greater visibility to and by other watercraft.

Maintenance is easy especially for embodiments comprised substantially of plywood construction.

Floatation vest compatible: Without moving parts and having no gunwales or hard projection from the rider deck, a rider of the buoyant wing may wear an approved floatation device and still propel via the heave and pitch propulsion motion.

Seaworthiness: During standing heave and pitch propulsion, the device and rider easily propel over waves and swells, and also thru combers and whitewater.

Already standing and moving, a user can catch waves more readily than can a prone-paddler.

Easily mass-produced due to the simple wing and foot-constraining device combination.

Speed: The standing rider being mostly above water and with only the below-knee portions of the legs in the water, and the buoyant wing being of small cross-section in comparison to a conventional surfboard, and being actuated by the leg thrusts of the rider, this human powered watercraft is capable of speeds beyond 10 miles per hour in a sprinting mode, and is capable of 5 miles per hour in what is an aerobically sustainable mode for many athletes.

The singular foot-constraining device whether comprised as an upper of a sandal or a foot-strap un-obviously allows the wing of the invention to weather-vane about a user's forward foot during upheaving of the wing from a depth in the water, and because no second foot-constraining device is present, the reduction in part count of the invention helps reduce fabrication costs and there after consumer costs while at the same time reducing the physical coordination of the upheave stroke, making learning the use of the invention easier than if it contained dual foot-constraining devices. Nevertheless, dual foot constraints have their place in this invention and are both illustrated and claimed.

Beach-starting is easy with the aft foot on shore and the forward foot ensconced within the foot-constraining device, the rider pushes off with the aft leg and is already flying, and, can then place the aft foot upon the deck of the wing and begin cycling in heave and pitch, down and up to maintain a speed across the water.

It is axiomatic in surfing and skim-boarding that to look down is to go down, that is, to wipeout, therefore, the unobvious simplification of this human powered watercraft when eschewing an aft-ward foot-constraining device, counter-intuitively makes it easier to operate in flight mode, and in the transition from a beach start, a white-water start, and a water start, since the aft-ward foot does not need to find a foot-constraining device and therefore, the rider does not need to look down, and will therefore not wipeout as often.

SUMMARY OF THE INVENTION

A human powered watercraft comprised as a buoyant wing, the buoyant wing having a deck upon which a rider may stand to heave and pitch the wing in water, propelling it forward in a chord-wise direction, which is transverse a wing span of the wing. The wing has a wing span, and a wing chord transverse the wing span, a wing thickness, and a wing leading edge and a wing trailing edge opposing the wing leading edge. An upper wing surface comprises the deck upon which the rider stands. A foot-constraining device is fixedly attached the wing proximate the wing leading edge and substantially centered upon the wing span, and projecting outwardly from the deck. The foot-constraining device is oriented to receive a rider's forward foot in a chord-wise direction, and aligns the rider's foot to span the wing chord-wise from leading edge toward a mid-chord position, the foot-constraining device thereby enabling the rider to upheave the submerged wing while at the same time allowing the wing to freely rotate to a pitch-up orientation. The foot-constraining device may be a simple foot strap, or an upper of a sandal, or waterski binding, or, it may be a surfboard traction pad, it may be a self-adhesive step tread, or, may be a surf-wax coating applied to the deck of the wing, and may comprise combinations of the foregoing.

Most simply, the buoyant wing of this disclosure may be fabricated from plywood by cutting out a wing shape from the plywood and sanding the resultant edges to a rounded configuration, and then, the plywood should be finished with water-resistant coats of varnish, or paint. Without limitation, the wing may have a wing-span about the height of a rider, more or less, and have a wing chord roughly equal the shoulder-width of the rider, more or less, and have a wing section thickness of a constant predetermined amount either flat on top and bottom of the wing or, be of tapered thickness to as little as an eighth of an inch, or, may have a thickness corresponding to a chordal section of a wing selected from the family of NACA wing chord sections between NACA-0001 AND NACA-0020.

The wing provides buoyancy which is enough to maintain a user's head above water when in a non-propelling mode, for example when a user is sitting upon the deck of the wing. The buoyancy of the wing can be greater such that the user if sitting upon the wing may have his or her shoulders or even upper chest area out of the water. However, the buoyancy of the wing cannot be so great as to prevent the wing from effectively being heaved and pitched downwardly into the water.

In one aspect, the wing is constructed solely from plywood and has a water-resilient coating of spar-varnish or paint.

In another aspect, the wing is constructed as a sandwich structure of impact absorbing polymeric foam covering a plywood wing structure and glued thereto, the polymeric foam substantially encompassing and circumscribing the plywood wing structure, and a foot-constraining device attaching a deck surface of the assembly and projecting outwardly from the deck, the foot-constraining device being proximate a leading edge (LE) of the wing.

In another aspect of the invention which is not illustrated in the figures, the wing is constructed of a wood spar proximate the wing quarter-chord line and running from a central portion of the wing to outboard portions of the wing approaching both wing tips of the wing. The wood spar of the wing in this aspect is covered by polymeric foam to complete the wing shape, the polymer foam being preferentially of a water resilient and closed cell structure. The foam of the wing may be covered partially with a fabric or may be substantially or completely covered by fabric, or may be entirely uncovered, having no fabric cover.

In another un-illustrated aspect, the wing is constructed of polymeric foam covered by laminations of fabric reinforced adhesive resin, the fabric being fiberglass cloth or carbon cloth, or other structural fabrics.

In still another illustrated aspect, the wing is combined with not one, but two foot-constraining devices, one proximate the wing leading edge (LE), and the second foot constraining device being proximate the wing trailing edge (TE). An example of this configuration is assembly 133 comprised of wing 1 and forward foot constraint 3 with aft foot constraint 3.

In still other aspects, the wing may be of construction combining some or all the above methods.

Some aspects of the wing have a shape which is elongate, approximating a user's height, or greater than ones height, or somewhat less, and with the chord width about shoulder width, yielding a wing having a wing area very large relative to the user's weight, and minimizing wing loading of the wing and thereby beneficially reducing the velocity of water-born flight such that users may bodily heave and pitch the wing at humanly sustainable speeds and so use the device for cardiovascular exercise and for recreational trips along the shore and out into the near littoral seas. Wing-span may substantially exceed a user's height even approaching as much as ten feet and beyond, the only natural physical limit being the onset of onerous fluidic drag and the added proclivity of great wing-spans to collect seaweed. Like-wise chord-widths may be greater or lesser than one's shoulder width and, this parameter too has no natural limit save fluid drag. Material cost of course, goes up with increases in span, chord-width and thickness, but is within the purview and dictate of the user.

Many aspects of the device take on planform shapes of the wing which are, without limitation, elliptic, rectangular, racetrack-oval, lenticular, trapezoidal, recto-elliptic, recto-circular, whale-tail shaped, goggle-shaped, and unlimited combinations of connected straight-line and curvilinear peripheries allowing wings of infinite variety within the confines of this disclosure and the claims.

Aspects of the system include a foot-constraining device attached proximate the leading edge of the wing and projecting outwardly from the deck. Without this foot-constraining device proximate the leading edge of the wing, the user is unable to upheave and is less able to control the wing when it is submerged. The foot-constraining device is safely slipped out of by the user during a fall. The use of a single foot-constraining device un-obviously expands the functionality of the system to enable beach-starting, while also forcing the wing to weather-vane during upheave by the rider.

Another aspect of the foot-constraining device is a simple foot-strap fixedly attaching the wing proximate the leading edge of the wing and projecting outwardly from the deck of the wing. The foot-strap is oriented substantially span-wise the wing and so orients a user's foot substantially chord-wise the wing allowing the foot to span across the wing from leading edge to approximately mid-chord the wing, thus allowing the single constrained foot to control pitch of the wing in upheave and down-heave. Absent a forward foot-constraining device, the user is less able to control the wing pitch in down-heave and is unable to upheave the submerged wing.

Another aspect of the foot-constraining device is an upper of a sandal fixedly attached the wing proximate the leading edge of the wing and projecting outwardly from the deck of the wing. The upper of a sandal is oriented so to orient a user's foot substantially chord-wise the wing allowing the foot to span across the wing from leading edge to approximately mid-chord the wing, thus allowing the single constrained foot to control the wing in upheave and down-heave. Absent a forward foot-constraining device, the user is less able to control the wing pitch in down-heave and is unable to upheave the submerged wing.

Another aspect of the foot constraining device comprises a conventional foot-binding of a water ski. Like the other foot constraining devices of this disclosure, the conventional water-ski binding is also proximate a leading edge of the wing and centered upon the wing span, whilst being oriented to make the rider's foot to be oriented parallel to chord-wise with respect to the wing.

Still another aspect of the foot constraining device is comprised as a surfboard traction-pad applied the deck proximate the center portion of the wing span and spanning from the wing leading edge to the wing trailing edge, the traction pad being of a width to fully underlay the feet of the user. The foot constraining device may also be a self-adhesive step-tread device commercially available such as that marketed by the company 3M under the SKU 5113159512. A surfboard traction pad, or, self-adhesive step-tread can be used in lieu of or in conjunction with other constraint devices.

In still another aspect of the foot constraining device, surfboard traction wax may be applied the deck of the wing across the entirety of the deck, serving both to frictionally constrain the rider's feet whilst he or she is standing upon the wing, but also to frictionally constrain the rider and the wing together when the rider is in a prone-paddling mode laying upon the wing. It also helps a rider to sit stably upon the wing. Used in lieu of other constraints, frictional constraints like surf wax, or step-tread, or a surfboard traction-pad frictionally constrain the rider's feet allowing at least for yaw control, but do not enable upheaving of the wing with the forward foot, and therefore, the rider must fly the board to the surface.

In many aspects of the system, the attachment of the foot-constraining device to the wing may be by screwing the foot-constraining device directly to the deck of the wing, or they may be adhesively bonded to the wing, or they may be glued and screwed to the wing. The use of screws for attachment should be of corrosion resistant steel, and preferably wood-screws, that is screws of corrosion resistant steel specifically for use in wood structure. The use of wood-screws is also applicable when attaching the foot-constraining devices to composite structures of the wing, whether the wing be comprised of all wood, or wood and foam, or fiberglass and foam construction, or any other composite construction, and also, wings of rotationally molded plastic. Using a wood-screw, it is not necessary to pre-drill a hole in the structure of the wing, but if desired to do so, one need only assure that the drill bit is approximately the diameter size of the shank of the screw, or slightly more, but there must be enough material after drilling to allow the threads of the screw to bite into solid structure. The use of adhesive to adhesively bond the foot-constraining device should be of a water-resistant grade of adhesive.

In still another aspect, the invention is comprised as an assembly of wing 1 and a polymeric foam 0, substantially covering and circumscribing wing 1, and, a foot-constraining device, the foot-constraining device may be a sandal-upper 3, a foot-strap 5, a conventional water-ski binding 7, a self-adhesive surfboard-traction pad 9, a self-adhesive step-tread 2, and, may be surfboard wax 4, and, may be combinations of these, such as the use of two sandal-uppers, or two foot-straps, one for a forward foot and one for an aft foot. Also, a sandal-upper or a foot-strap may be used together with surf wax, or step-tread, or surfboard traction pad.

Wing sizing by a rider or fabricator: For beginning riders, size the wing so to achieve a wing area of not less than 1 foot squared per twenty pounds of rider body weight. For a two-hundred pound man, and using a wing of substantially elliptic shape, the first key dimension is chord length. The chord length of the wing should approximate the shoulder width of the athlete, more-or-less. This allows the athlete to lay upon the wing and prone-paddle the wing for self-rescue and, when tired and for recreation. It also allows a wide stance upon the wing which for most athletes is usually comfortably shoulder width wide, having a front foot proximate the wing leading edge and in the foot-constraining device, while an aft foot of the athlete is placed proximate the trailing edge of the wing. This allows differential weighting of the feet to affect changes in pitch during down-heave of the wing. Next, the wing-span is determined, and can be head-high or longer or shorter depending upon user preference. Selecting a 6½ feet wing-span for the two-hundred pound athlete, and further deciding upon an elliptic plan-form shape, the rough area of an ellipse having a major length of 6½ feet, and a minor width of 2 feet, making an ellipse of 6½ feet by 2 feet, develops an elliptic wing area of about 10.2 feet squared wing area. Wing area loading will therefore be 200 pounds divided by 10.2 feet squared, which is equal 19.6 pounds per foot squared.

A lighter weight athlete of say, 100 pounds could use an elliptic wing of 5 feet wing-span by 2 feet chord width and so develop a wing area of 7.85 feet squared wing area, and therefore a wing area loading of 12.7 pounds per foot squared.

The lesser the value of wing loading, the easier it is to maintain water-born flight at slow and physically sustainable speeds. That is to say, the bigger the wing, the better, however, it is presently preferred that a wing be of a wing-span and, a chord-width which is conveniently carried by a rider so, wing sizes approximating rider height in wing-span and rider shoulder-width in wing-chord dimensions are envisioned although individual rider preferences for wing-span may be substantially greater or lesser than one's physical height, and likewise preferences for the wing-chord dimension of an individual's wing may be substantially greater or lesser than one's shoulder-width. Most beginning riders will prefer a wing-span nearly to head-height of the rider, plus or minus a foot of length. Likewise, chord-width of the wing is optimal when equal the rider's shoulder width, plus or minus a half-foot. Elliptic wing planforms naturally develop efficient and elliptic wing pressure distributions, and ergonomically favor the rider when laying upon and hand-paddling the wing shoreward.

Wing sizing for experienced riders is entirely subject to their own preferences as dictated by skill level and athletic power versus rider weight, limited only by the natural level of impedance required by the rider to productively propel at speeds of one's preference, so, wings may be smaller or larger than previously described and are unlimited by this disclosure.

OPERATIONAL SUMMARY

The buoyant wing assemblies of the disclosure are operated by athletes in water to achieve forward motion in the water, which motion is transverse the wing span which is chord-wise in direction as follows:

a) With the buoyant wing of this disclosure in a body of water, and with the foot-constraining device upward, a rider places his or her forward foot into the foot-constraining device, and with one's aft-ward foot upon solid ground or sand bottom, the athlete thrusts aft-ward the aft foot to attain an initial seaward motion of the wing and rider and, commences to glide into the sea forward along a chord line of the wing with the wing and rider descending down into the water for several inches to achieve an initial down-heave of the wing;

b) now gliding both forward into the sea and downwardly, the rider places the aft foot upon the wing deck proximate the trailing edge of the wing;

c) the rider then distributes his or her weight upon both feet such that a gently descending glide of the wing is achieved and continues both forward and down to a predetermined position, generally descending to a depth from a few inches to as many as 20 inches or somewhat more;

d) at a predetermined depth of descent, the rider bends both knees and bounds energetically upward, achieving a vertical height;

e) the rider then draws upward at least the forward foot and thereby, the wing leading edge, causing the wing to weather-vane and to climb toward the surface of the water;

f) upon breeching the surface of the water with the wing, or at a predetermined depth below the surface of the water, the rider redistributes their body weight upon the wing deck so to attain a pitch-down attitude of the wing, and so begins again to glide forward and down;

g) the rider may continue the cycle of propulsion as desired consecutively bounding and upheaving, and then gliding upward toward the surface to down-pitch and down-heave again and again.

Beach start: A rider of the wing stands with an aft foot upon ground or sea-bottom, and with the forward foot ensconced within a foot-constraining device of the wing, bodily lunges seaward with the ground leg to begin a propulsion cycle of this human powered watercraft, then upon attaining a chord-wise forward velocity of the rider and wing in the water, the rider places the aft-ward foot upon the deck of the wing and distributes his or her body weight to attain a preferred glide path, gliding forward and down thru the water.

Water start: With rider and wing in water, and with the rider's forefoot ensconced within the foot-constraining device, and with the rider's rear foot upon the wing deck proximate the trailing edge of the wing, the rider draws both legs upward to substantially fold under her upper body, thereby drawing the buoyant wing upward until it settles roughly horizontally and in full contact with the rider's feet, the rider then energetically bounds upward clearing as much of her body out of the water as possible, and when she has fully straightened her legs, she draws the forward foot upward again and so draws the wing surface-ward. When the wing has reached its zenith or has breached the surface of the water, she then weights the feet upon the deck of the wing so to achieve a downward pitch of the wing, whereupon she glides forward and down until coming to a predetermined depth in the water, whereupon, she once again upwardly bounds, and by continuation of the upheave and down-heave cycle, achieves a forward speed in the water which forward speed is chord-wise and transverse the wing-span of the wing.

Whitewater start: During wave conditions and where the shore is hit by waves and whitewater of some energetic level, a rider can begin a riding session by standing at the shore and with one's forefoot in the foot-constraining device, and with one's aft-ward foot solidly upon the deck of the wing proximate the wing trailing edge; one waits until an in-coming wave and whitewater spill onto shore and at the moment just before the wave inundates the wing, the rider bounds upwardly and immediately draws up the leading edge of the wing, allowing the wave to roll under the wing, and drive the wing and rider vertically up. The rider then settles their weight upon the wing and settles into a horizontal glide, gliding thru the moving water whilst maintaining position or drifting aft-ward with the onslaught of the wave, and until one has attained balance equilibrium, whence one can begin heaving and pitching the wing to escape the shallows and attain a velocity seaward. As one proceeds farther seaward generally one may heave the wing more deeply in the deepening water.

Terms, Symbols, Abreviations, and Reference Numerals

Watercraft: Any vessel operable by a rider upon bodies of water, and in this disclosure is meant any vessel which can be propelled by human exertion, powered by the human engine, the vessel generally not longer than twenty feet, and particularly is meant the family of surfboards, skim-boards, body-boards, swim-boards, paddle-boards for prone paddling, stand-up paddle-boards, and wake-boards.

Buoyant Wing: A device resembling a conventional aircraft wing except that it is intended for use in a body of water as a watercraft, and is both watertight and is substantially lighter than water.

Surfboard: A small watercraft of light weight and of size easily carried under arm by a surfer, generally a surfboard is elongate and of a width less than a third of its elongate dimension, but its breadth is rarely greater than can be carried under-arm.

Skim board: A finless watercraft, conventionally of length about twice its width and constructed of plywood, used for skimming atop thin films of water at the shore edge and also to ride out seaward to approaching waves so to catch the wave and surf it back shoreward. Conventional skim boards are smaller than conventional surfboards.

Foot-constraining device: A foot-bridle, a water ski binding, a foot strap, a stirrup, an upper of a sandal, a surfboard traction-pad, frictional step-tread such as 3M company SKU 5113159512, or surf wax applied the deck of the wing, all of which release-ably receive a foot of the rider. In the case of applied surf wax, the constraint provided is shear constraint as like that of a traction-pad or step-tread. All three of surf-wax, step-tread material, and surfboard traction-pads may be applied locally the deck of the wing or, extend continuously across the deck from wing-tip to wing-tip, and from leading edge (LE) to trailing edge (TE). Combining various constraints from above in application to a particular wing assembly is within the scope of this invention and there is no limit here to the number and method of combination.

NACA section of a wing: National Advisory Committee for Aeronautics section of a wing; that sectional curvature of a wing when the wing is cut longitudinally from leading edge to trailing edge along a wing-chordal line. Optimizing the lift-to-drag characteristics of a wing, so to minimize user exertion for a given speed in the water, it is presently preferred, but without limitation that the wing bottom of this device be flat so to maximize the in-ground effect of the wing when flying or skimming near lake or sea bottom, while it is also preferred to minimize the thickness of the wing, so, NACA sections between NACA-0001, and NACA-0020 are preferred. NACA section NACA-0010 for example is flat upon wing bottom and is of a maximum thickness of 10% of the wing chord; A wing of NACA-0001 section would be 1% thickness of the wing chord; A wing of NACA-0020 section would be 20% thickness of a wing chord, and so on.

LE: the leading edge of a wing.

TE: the trailing edge of a wing.

T: wing thickness. Thickness can be constant as in the case of a wing of a single piece of plywood. Thickness can be of stepped plywood laminations; a wing of two pieces of plywood can be of two discreet thicknesses; a wing of three pieces of plywood can have three discreet thicknesses, for example. Thickness can also vary according to the surface definition for various NACA wing profiles, especially wing profiles NACA-0001 thru NACA-0020, though any wing definition may apply and this disclosure has no limit to wing surface topography.

SC: an attachment screw, preferably of corrosion resistant steel used to fixedly attach a foot-constraining device to the wing of the invention.

Wing span: the breadth of the wing, from wing tip to wing tip

Wing chord: the length of the wing from leading edge to trailing edge.

Beach start: A rider of the wing stands with an aft foot upon ground or sea-bottom, and with the forward foot ensconced within a foot-constraining device of the wing, bodily lunges seaward with the ground leg to begin a propulsion cycle of this human powered watercraft, then upon attaining a chord-wise forward velocity of the rider and wing in the water, the rider places the aft-ward foot upon the deck of the wing and distributes his or her body weight to attain a preferred glide path, gliding forward and down thru the water.

Water start: With rider and wing in water, and with the rider's forefoot ensconced within the foot-constraining device, and with the rider's rear foot upon the wing deck proximate the trailing edge of the wing, the rider draws both legs upward to substantially fold under her upper body, and thereby drawing the buoyant wing upward until it settles roughly horizontally and in full contact with the rider's foot-soles, the rider then energetically bounds upward clearing as much of her body out of the water as possible, and when she has fully straightened her legs, she draws the forward foot upward again and so draws the wing surfaceward. When the wing has reached its zenith or has breached the surface of the water, she then weights the feet upon the deck of the wing so to achieve a downward pitch of the wing, whereupon she glides forward and down until coming to a predetermined depth in the water, whereupon, she once again upwardly bounds, and by continuation of the upheave and down-heave cycle, achieves a forward speed in the water which forward speed is chord-wise and transverse the wing-span of the wing.

Whitewater start: During wave conditions and where the shore is hit by waves and whitewater of some energetic level, a rider can begin a riding session by standing at the shore and with one's forefoot in the foot-constraining device, and with one's aft-ward foot solidly upon the deck of the wing proximate the wing trailing edge; one waits until an in-coming wave and whitewater spill onto shore and at the moment just before the wave inundates the wing, the rider bounds upwardly and immediately draws up the leading edge of the wing, allowing the wave to roll under the wing, and drive the wing and rider vertically up. The rider then settles their weight upon the wing and settles into a horizontal glide, gliding thru the moving water whilst maintaining position or drifting aft-ward with the onslaught of the wave, and until one has attained balance equilibrium, whence one can begin heaving and pitching the wing to escape the shallows and attain a velocity seaward. As one proceeds farther seaward generally one may heave the wing more deeply in the deepening water.

Pearling, and Wipeout: Pearling is to bury one's surfboard or skim board nose underwater while travelling at speed upon the water, resulting invariably in a wipeout which is to fall uncontrollably off one's surfboard, or skim board.

0: Polymeric foam, used here as both a buoyancy device and as a shock-absorbing device, and, in this case is done by encasing or substantially covering the buoyant wing as shown in FIGS. 2M and 2N as assembly 103.

1: The wing 1 comprised of a top surface, a spaced apart bottom surface, a circumscribing edge surface having both a leading edge and a trailing edge, the wing having a wing span, and a wing chord, and a wing thickness, and being watertight and being of a density less than water, and the wing having a buoyancy in water.

3: A foot-constraining device comprised as an upper of a sandal.

5: A foot strap.

7: A conventional water ski binding.

9: A conventional traction-pad for a surfboard, skim board, and the like.

13: A skim board assembly comprised of wing 1 and foot-constraining device 3.

15: A skim board assembly comprised of wing 1 and foot-strap 5.

17: A skim board assembly comprised of wing 1 and water-ski-binding 7.

19: A skim board comprised of wing 1 and traction-pad 9.

133: A skim board assembly comprised of wing 1 and two foot-constraining devices 3.

123: A skim board assembly comprised of wing 1, and self-adhesive tread-deck 2 applied the deck and covering at least a foot's width down the center of the wing and spanning from the wing leading edge (LE) to the trailing edge (TE), and foot-constraint 3, a sandal upper proximate the leading edge (LE) of wing 1.

2: Self-adhesive tread-deck; readily available at hardware stores and home improvement stores, tread-deck is a form of emery cloth with a gummy adhesive applied opposite the grip surface. Typically used for outdoor steps to minimize foot slippage when wet. The step-tread here is applied the deck of wing 1 as described above.

143: Assembly 143 is comprised of wing 1, and foot-constraint 3 a sandal upper projecting outwardly from the deck of the wing, proximate the wing leading edge (LE), and, surf-wax 4 applied across the entire deck surface of the wing.

4: Surf-wax applied by a user to frictionally constrain the feet of the user when standing upon the deck of the wing of the many aspects discussed herein. The wax also helps stabilize the user when sitting and laying upon the deck.

103: Assembly 103 is comprised of wing 1, covered by polymeric foam 0 which entirely envelopes and circumscribes wing 1 and acts as an impact absorbing and buoyancy enhancing device. Sandal-upper 3 attaches wing 1 and projects outwardly from the deck and is attached proximate the wing leading edge (LE).

188: A surfboard assembly 188 comprised of buoyant wing 1 and two stabilizing fins 8, stabilizing fins 8 fixedly attaching the underside of wing 1 proximate the trailing edge of wing 1 and proximate a central wing-span portion of wing 1, fins 8 being substantially parallel each other and substantially parallel a chordal direction of wing 1.

Shoreline: Where the water meets land. Used synonymously with ground-line.

Ground-line: Where the land meets the water. Used synonymously with shore-line.

DETAILED DESCRIPTION OF THE DRAWINGS

FIG. 1A: Isometric view of a human rider (in phantom) upon one aspect of the human powered watercraft, assembly 13, comprised of wing 1 and foot-constraining device 3, the rider's forward foot ensconced within the foot-constraining device 3, and his aft foot upon the ground, the rider preparing to perform a beach-start by thrusting the aft foot, thus propelling the rider and watercraft forward into the water in a chordwise forward direction represented by the arrow-vector proximate the leading edge of the wing 1. Also shown, the wing having a leading edge (LE), and a trailing edged (TE). Also shown, the intersection between shore and ground represented as shoreline and ground line.

Figure 1B:
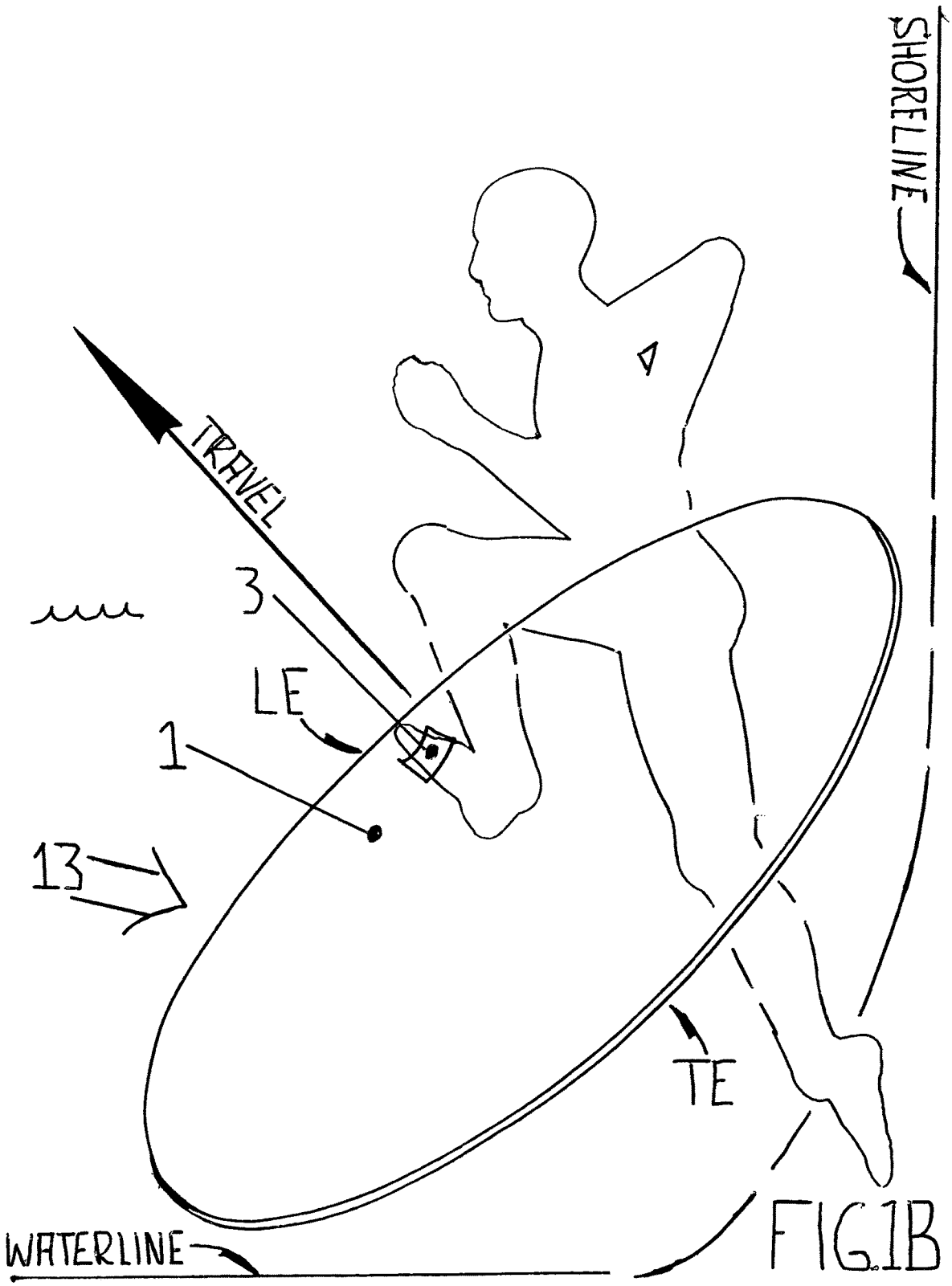

FIG. 1B: Isometric view of assembly 13, the combination of wing 1 and foot-constraining device 3, and a rider (in phantom), the rider in mid-thrust performing a beach start to propel the rider and watercraft to an initial flight speed in the water, the waterline and shoreline shown as a curve also in phantom.

Figure 1C:
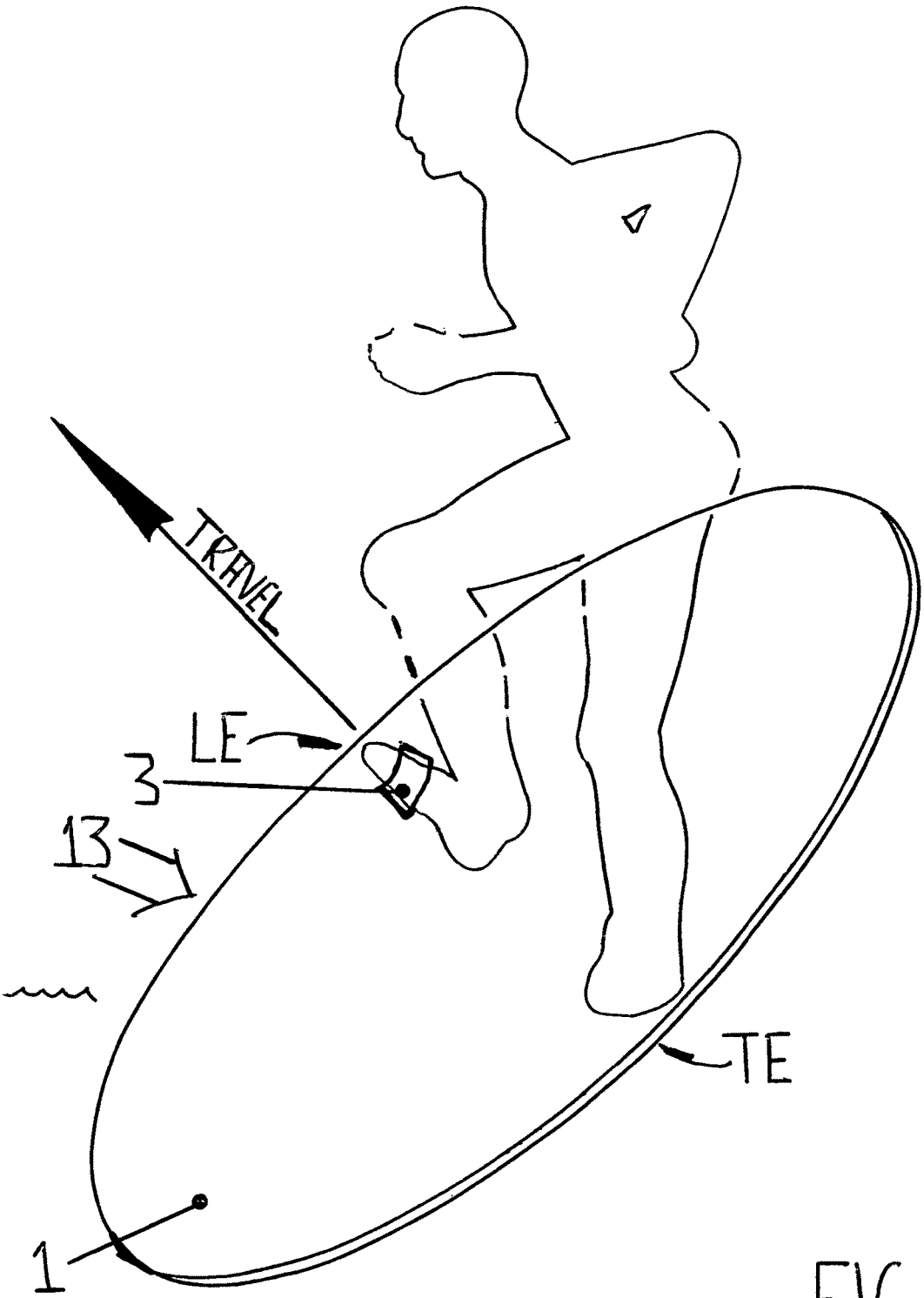

FIG. 1C: Isometric view of assembly 13 comprised of wing 1 and foot-constraining device 3 upon which a rider (in phantom) is standing. The rider standing upon an upper surface of the wing 1, the upper surface of the wing may elsewhere be referred to as a deck of the wing. Wing 1 is shown in oblique view having a leading edge (LE) and a trailing edge (TE). The rider's forward foot is ensconced within the foot-constraining device 3 and the rider's aft foot is upon the deck, proximate the trailing edge (TE) of the wing 1 of the assembly 13. This rider stance enables the rider to perform the heave-and-pitch propulsion of the watercraft in the water.

Figure 1D:
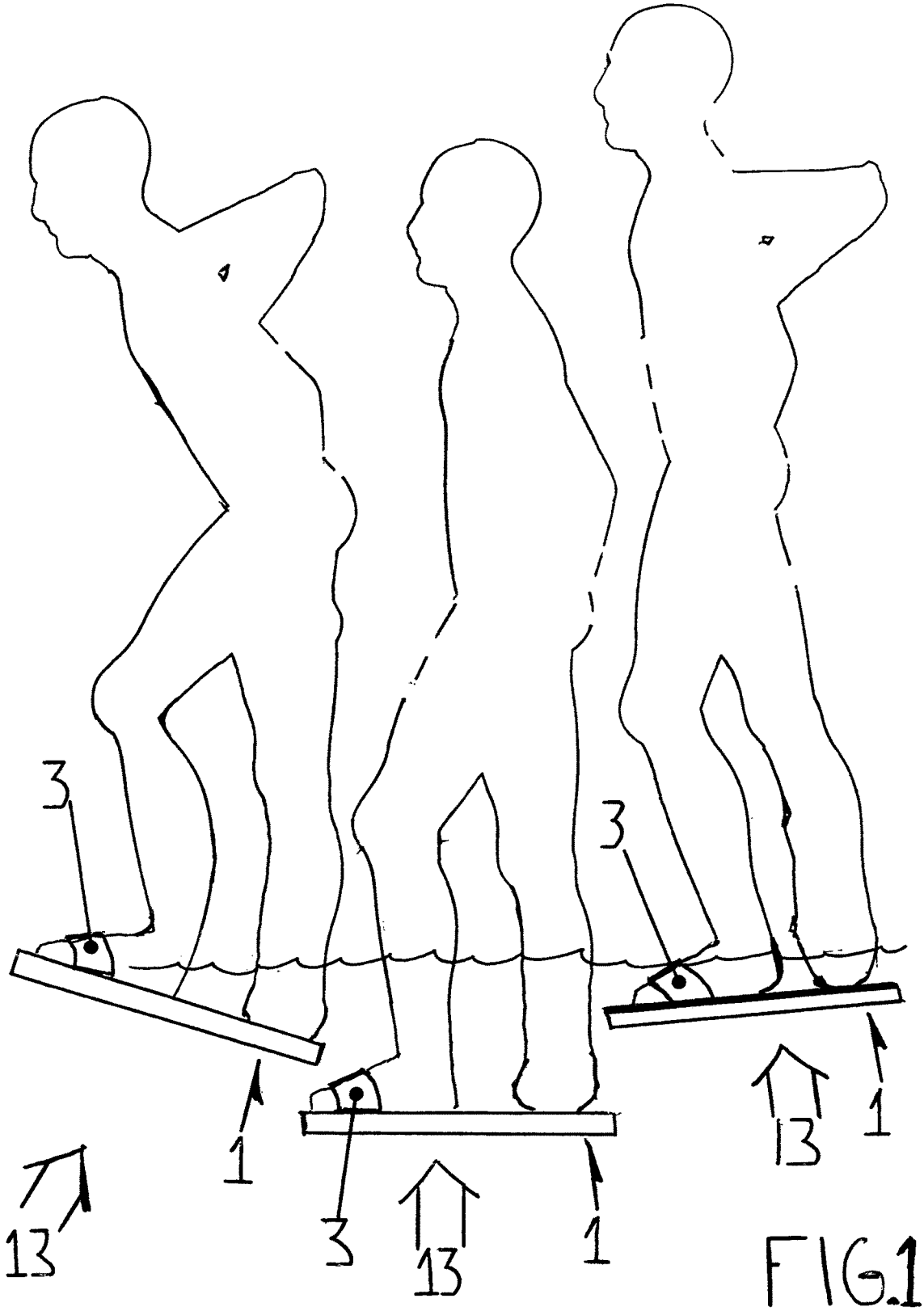

FIG. 1D: Side view of assembly 13 comprised of wing 1 and foot-constraining device 3 with a rider (in phantom) having both feet upon the deck surface of wing 1, rider and watercraft gliding forward and down thru the water, heaving downward by body-weight and, pitching downward by differential weighting of the rider's two feet. Forward in the figure being from Tight to left. The rider upheaving the watercraft in the left side of the figure by genuflecting, drawing the knee of the forward leg upward to up-pitch the leading edge (LE) of the watercraft and glide upward toward the water surface. FIG. 1D demonstrates the fundamental heave-and-pitch method of propulsion of the watercraft of this disclosure.

Figure 1E:
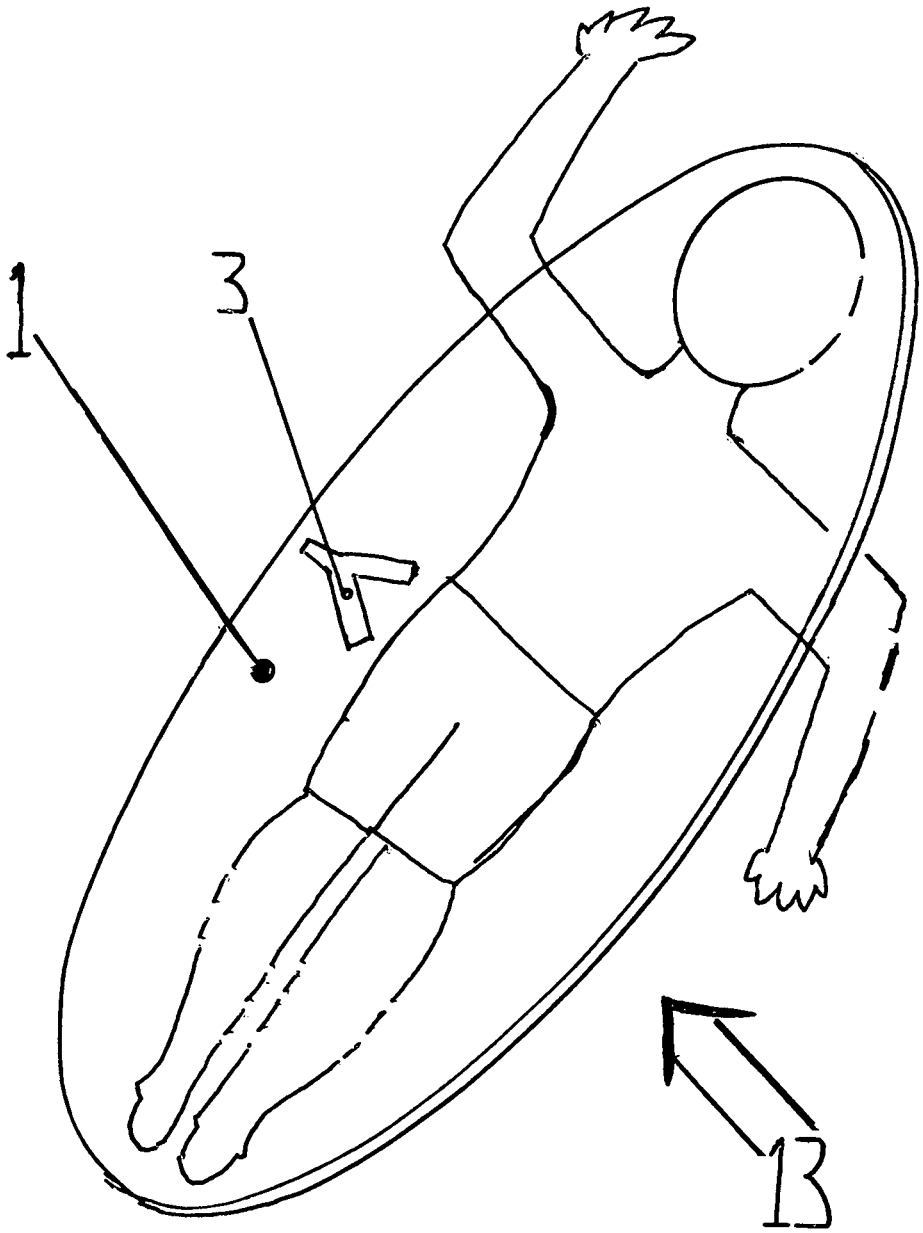

FIG. 1E: Isometric view looking down upon a paddler (in phantom) laying upon board assembly 13, board assembly 13 comprised of wing 1 in combination with upper-of-a-sandal 3, the forward foot constraint, exemplifying the second use potential of the board-wing-hydrofoil of this disclosure; self-rescue of this system is particularly benign for the rider who has become tired; the rider merely lays upon the board and paddles shore-ward.

Figure 2A:
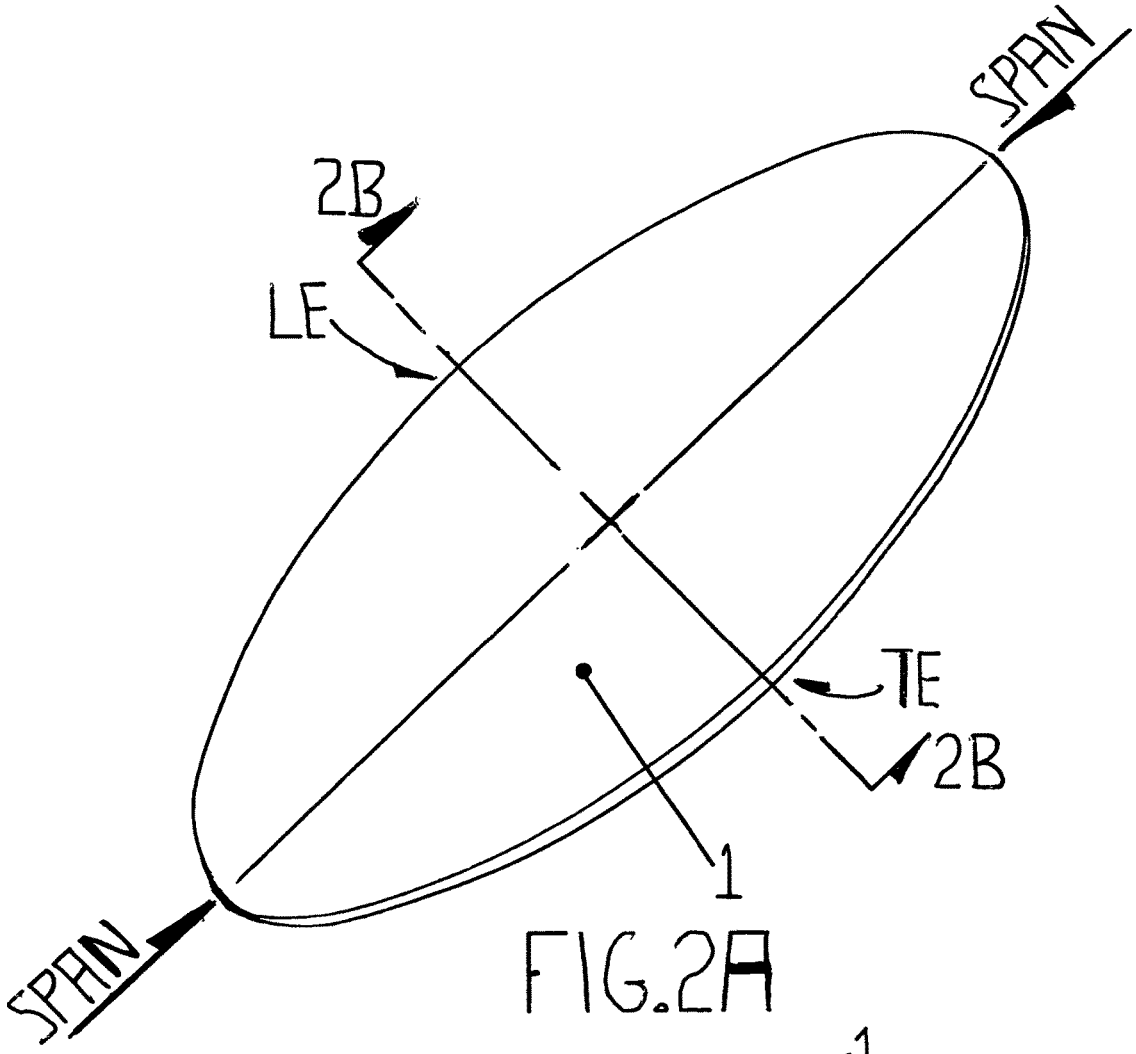

FIG. 2A: Isometric view of wing 1 of elliptic planform.

Figure 2B:
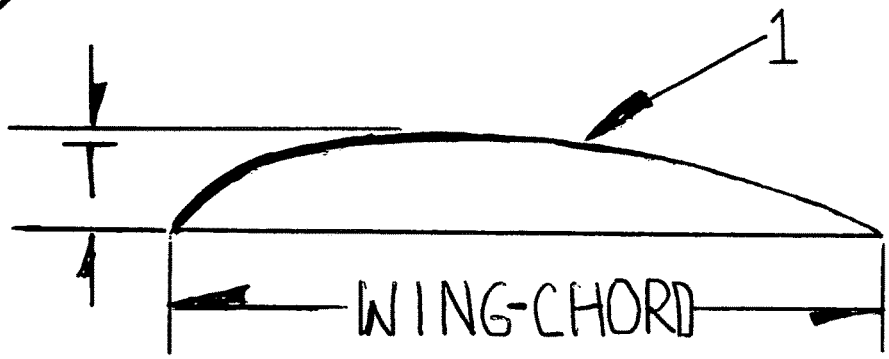

FIG. 2B: Cross-section view of wing 1 showing classic wing contours of a flat bottom and a curved top consistent with that family of wing sections between NACA-0001 to NACA-0020 wing sections, which without limitation are useful to the many aspects of the human powered watercraft of this disclosure. Other NACA wing sections in infinite variety may be applied this invention for useful performance outcomes such as increased lift, decreased drag, higher sustainable cruise speed, and highest achievable top speed.

Figure 2C:
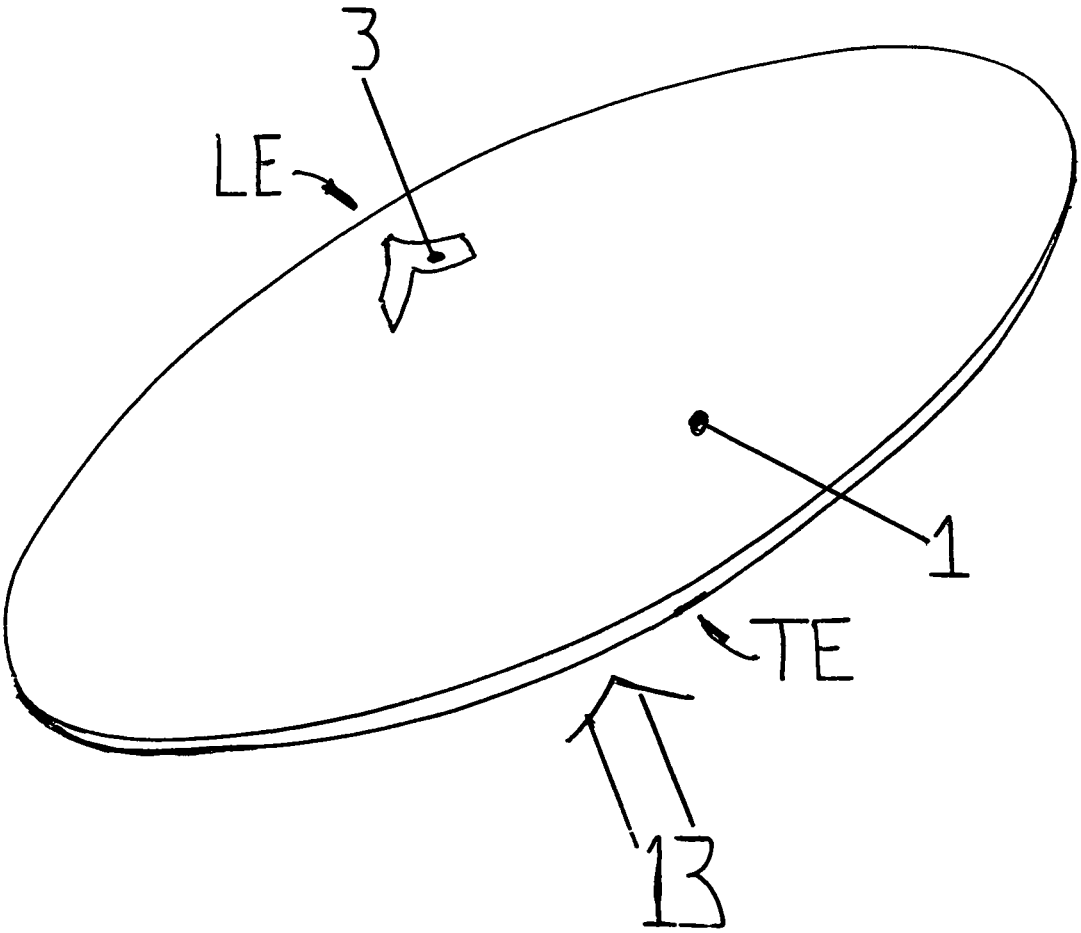

FIG. 2C: Isometric view of assembly 13 comprised of wing 1 and foot-constraining device 3, foot-constraining device 3 being proximate the leading edge (LE) of the wing, and, also proximate a wing-span centerline. Wing 1 in its simplest form may be common plywood cut out in the shape of a wing, for example of elliptic shape, and having only the unvarying plywood thickness as store-bought.

Figure 2D:
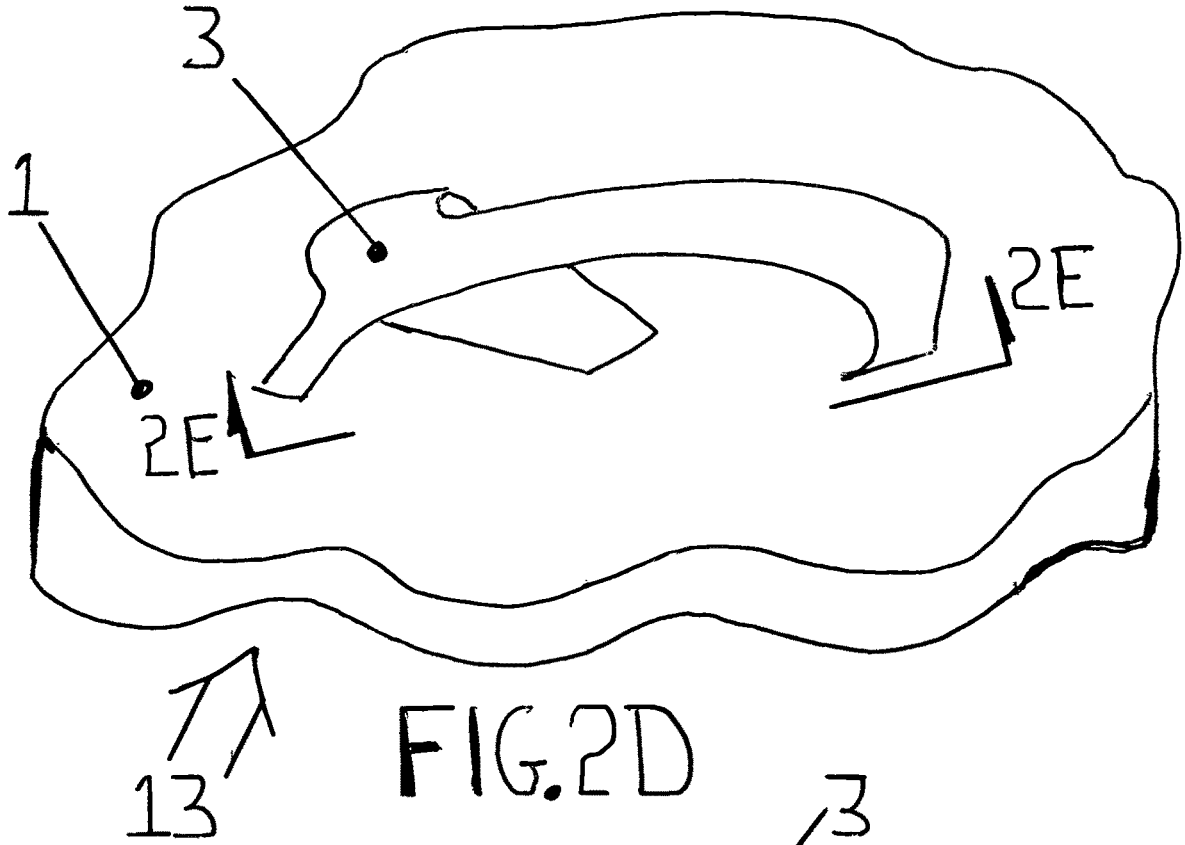

FIG. 2D: Isometric view of foot-constraining device 3 comprised as an upper of a sandal, projecting outwardly from the deck of wing 1.

Figure 2E:
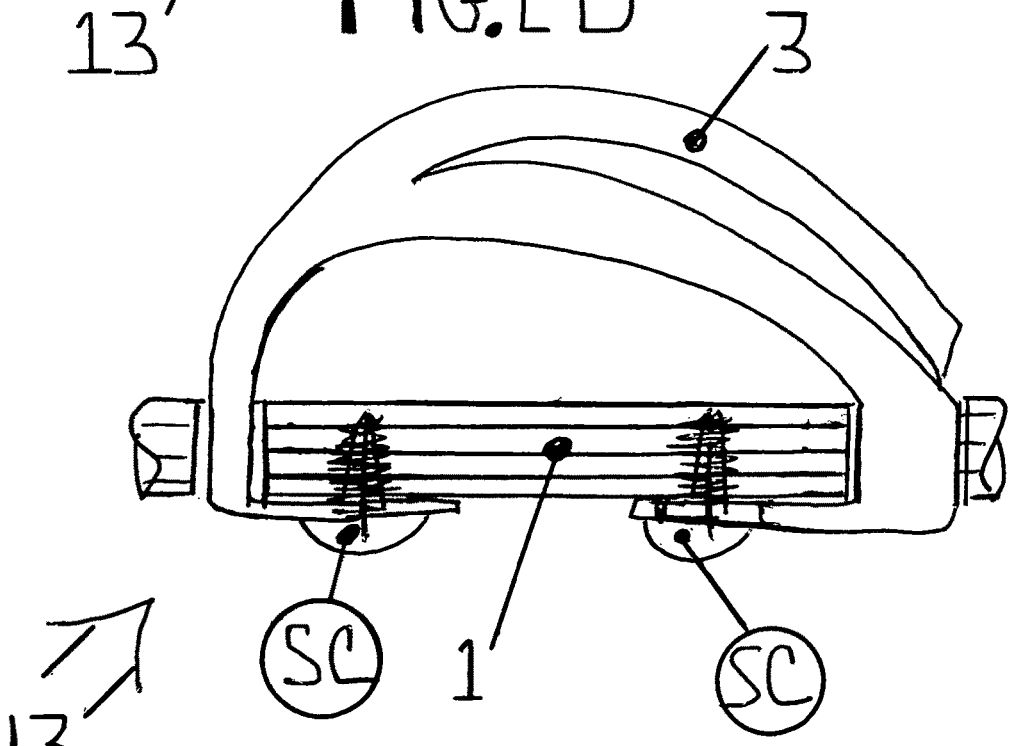

FIG. 2E: Section view of assembly 13 comprised of wing 1 and upper-of-a sandal 3. Upper-of-a sandal 3 projects outwardly from the deck of wing 1, wing 1 being comprised of plywood laminations, and attachment screws (SC).

Figure 2F:
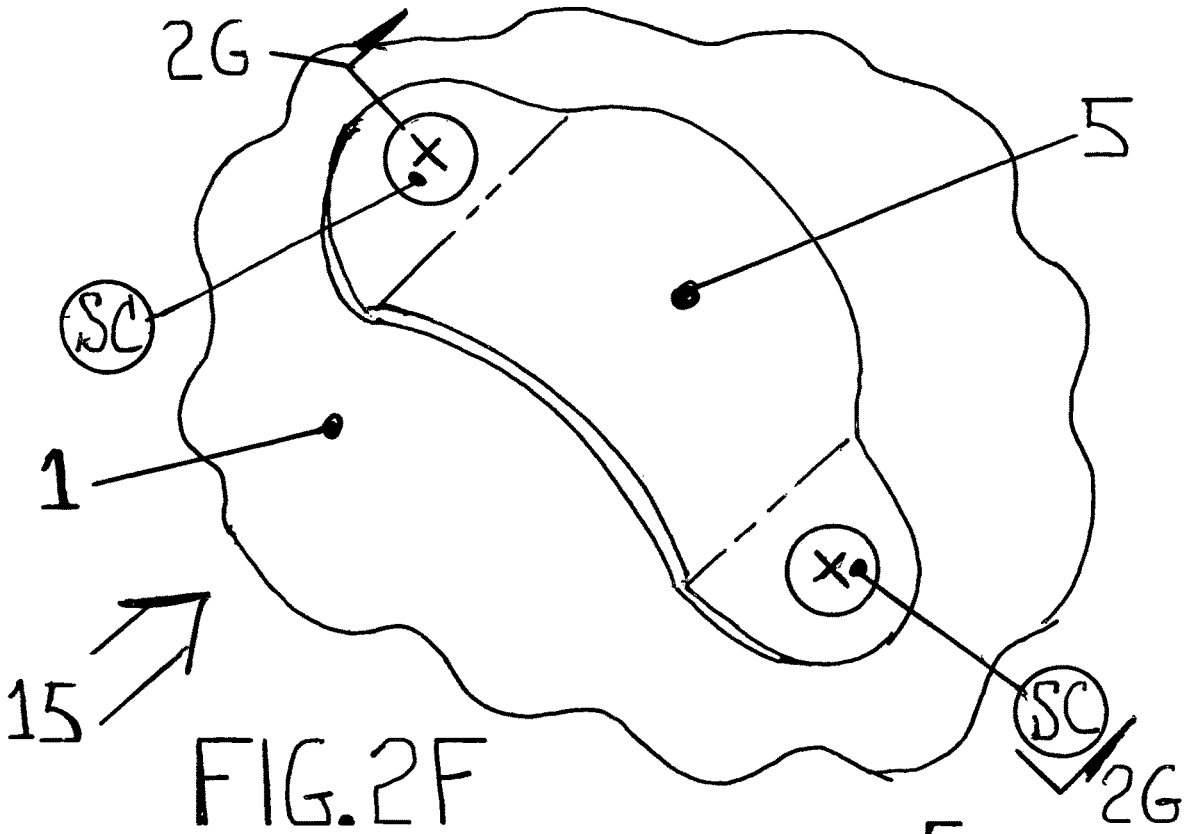

FIG. 2F: Isometric view of assembly 15 detail showing foot-strap 5 projecting outwardly from wing 1 and fastened to wing 1 by conventional wood screws. Wood screws being conventional items common to construction and well known to those of normal skill and knowledge are here in figures represented by an encircled SC, and in text represented individually as screw (SC).

Figure 2G:
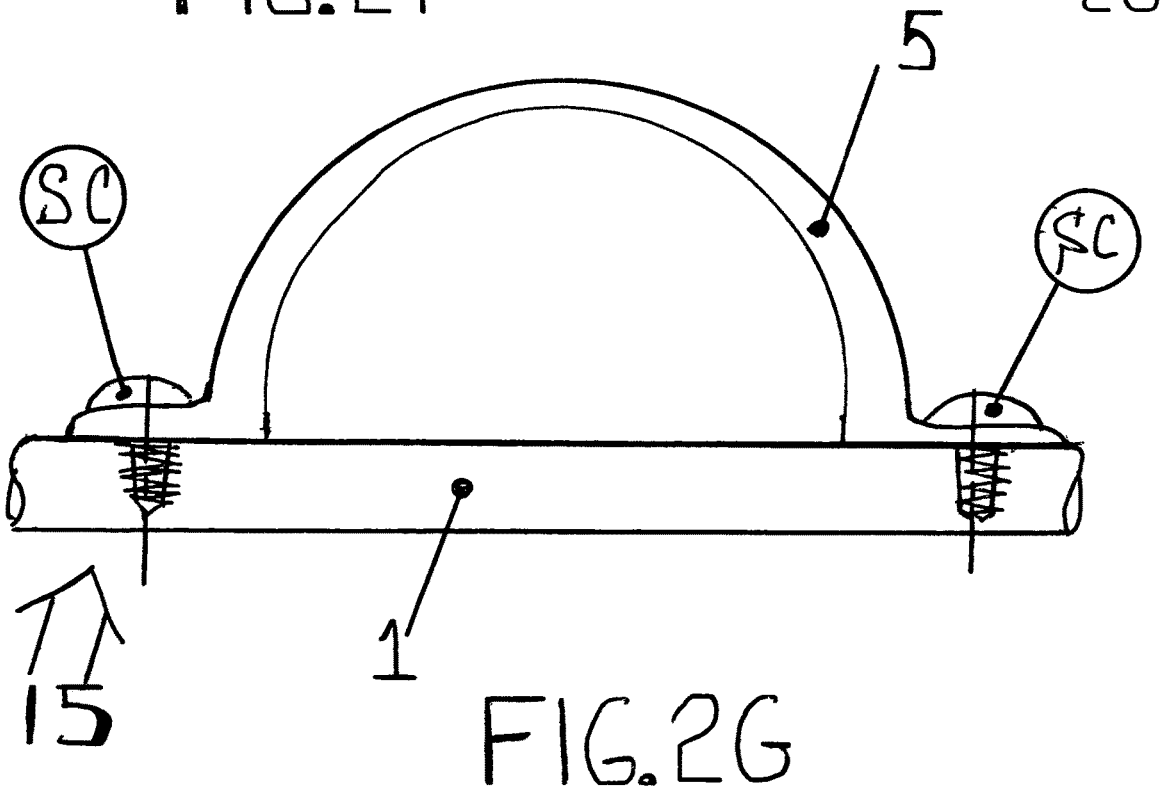

FIG. 2G: Section view of assembly 15 showing foot-strap 5 projecting outwardly from wing 1, and two of wood screw (SC) attaching foot-strap 5 to wing 1.

Figure 2H:
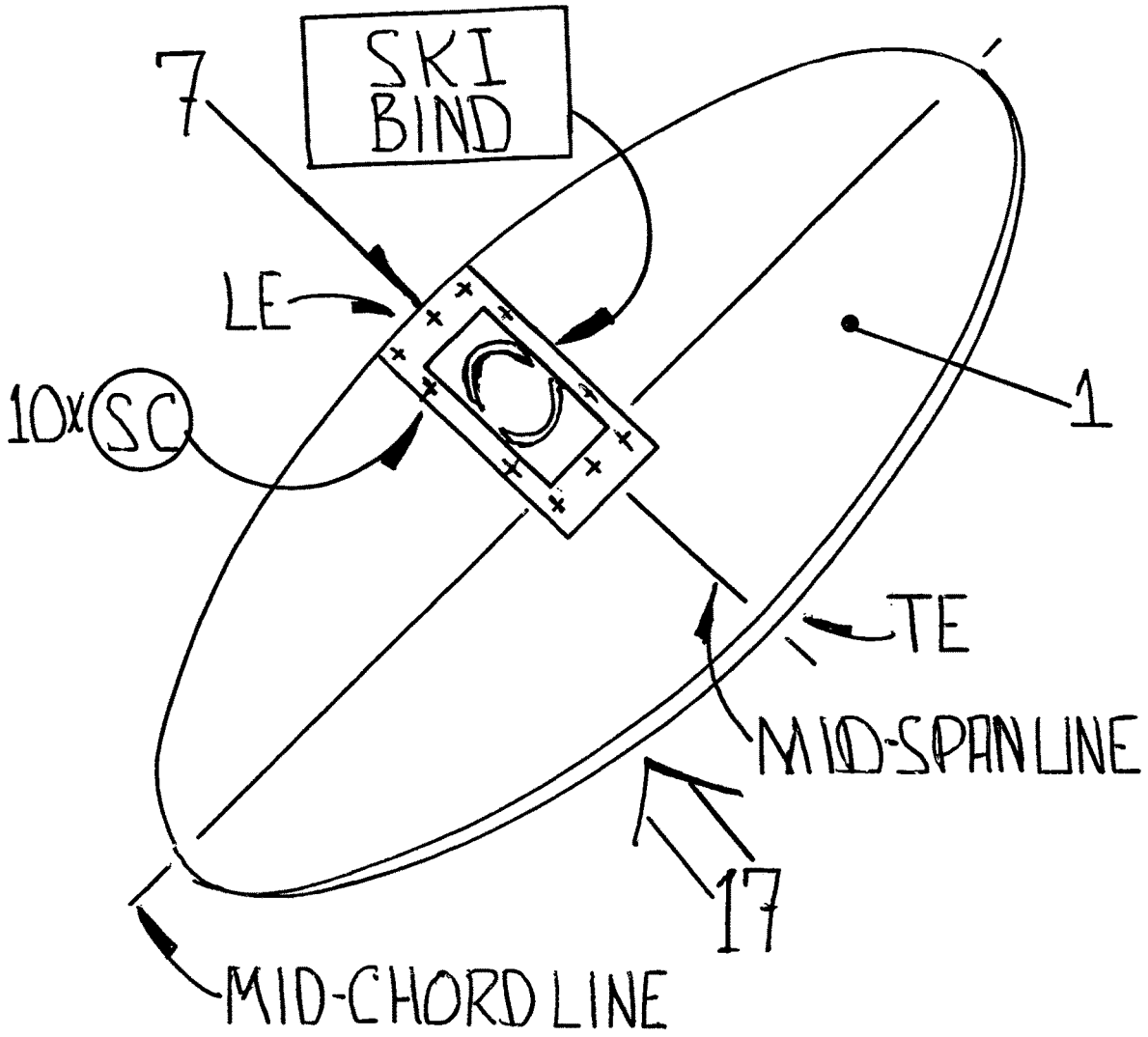

FIG. 2H: Isometric view of assembly 17 comprised of wing 1, water-ski binding 7, and 10 attachment screws (SC), attaching water-ski binding 7 to wing 1.

Figure 2I:
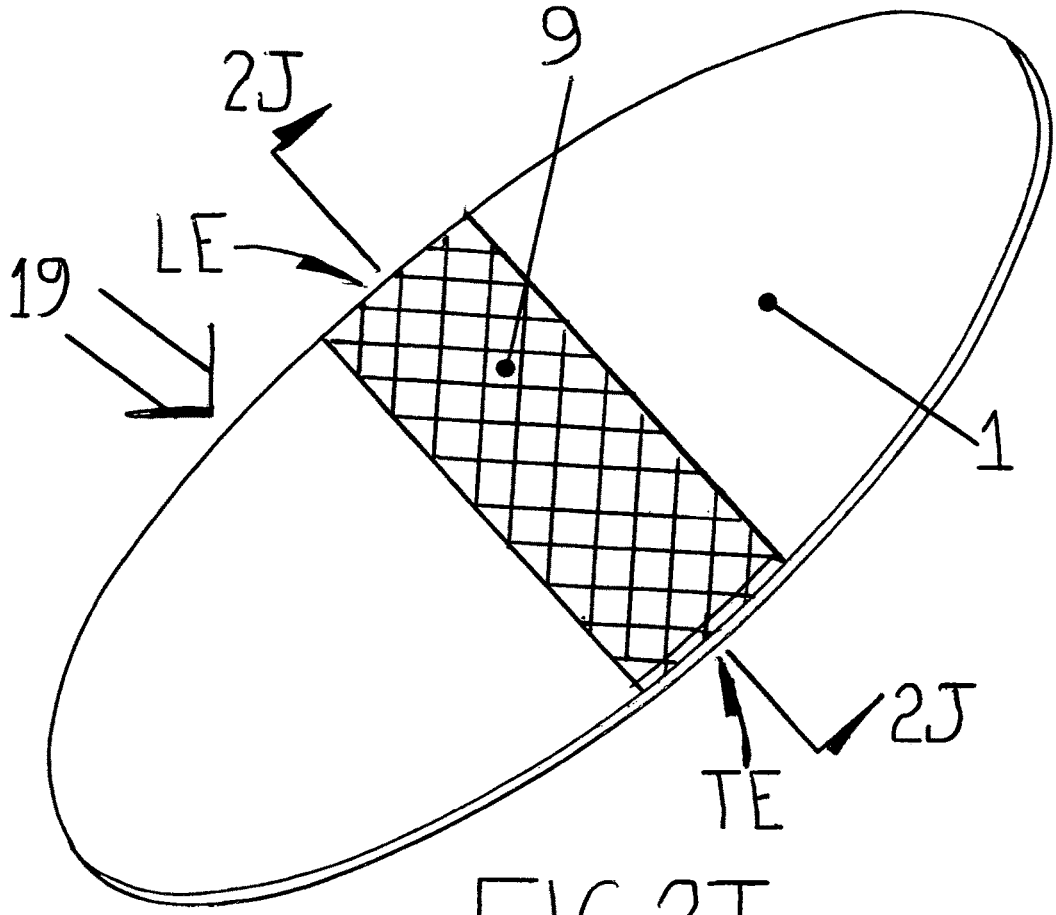

FIG. 2I: Isometric view of assembly 19, comprised of wing 1 and surfboard-traction-pad 9, surfboard traction-pad 9 spanning from wing 1 leading edge (LE) to wing 1 trailing edge (TE) and is used here in lieu of any other constraining device.

Figure 2J:
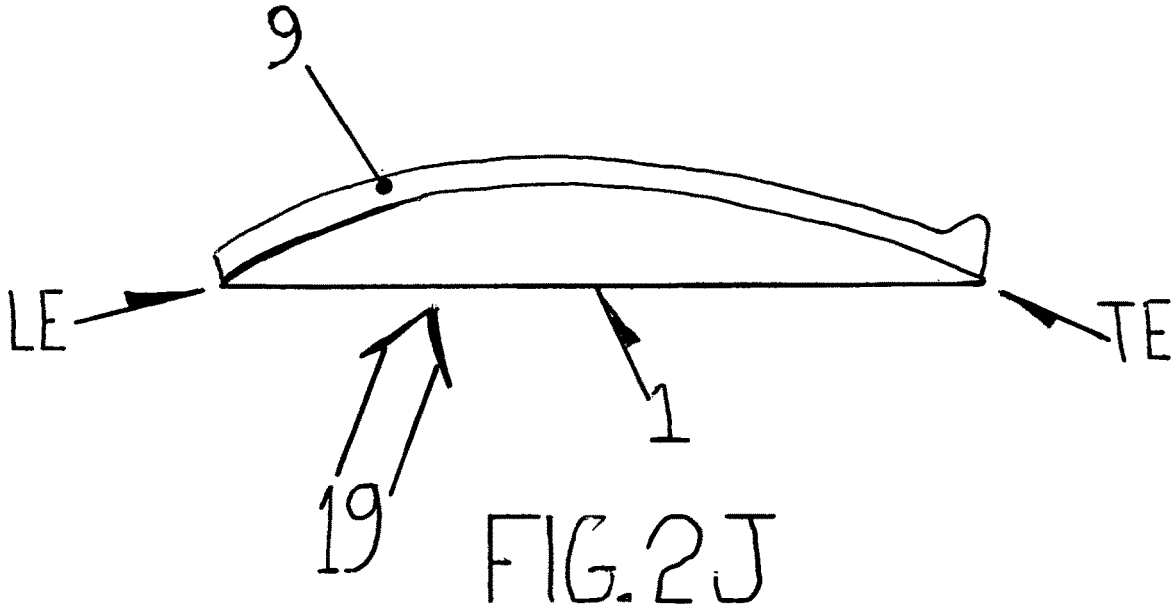

FIG. 2J: Section view of assembly 19 comprised of wing 1 and surfboard-traction-pad 9, used in lieu of any other foot constraint in this embodiment.

Figure 2K:
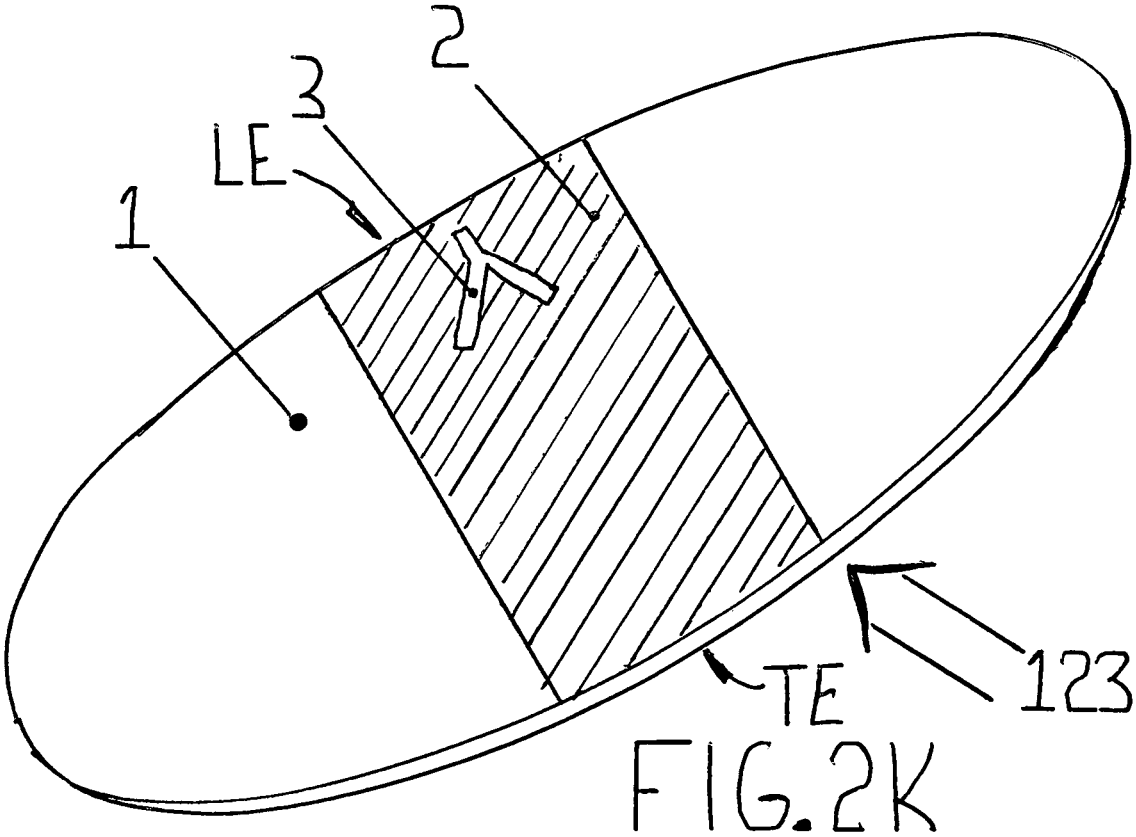

FIG. 2K: Isometric view of assembly 123 comprised of wing 1, step-tread 2, and sandal-upper 3.

Figure 2L:
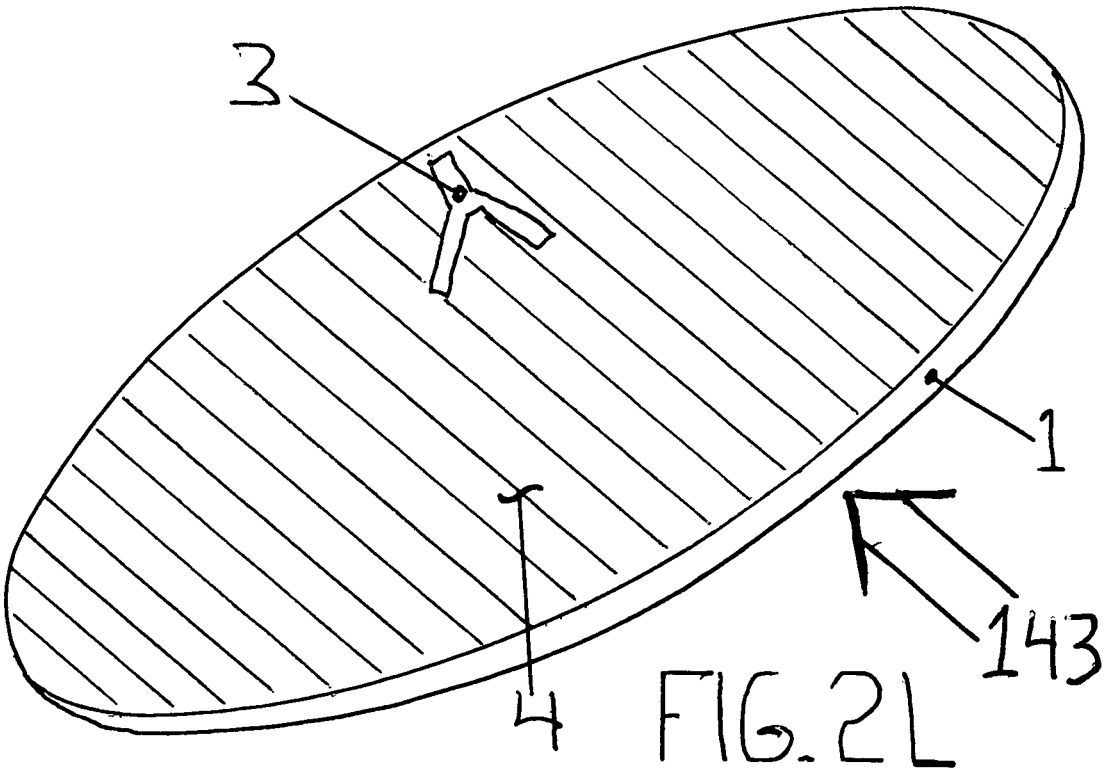
Figure 2M:
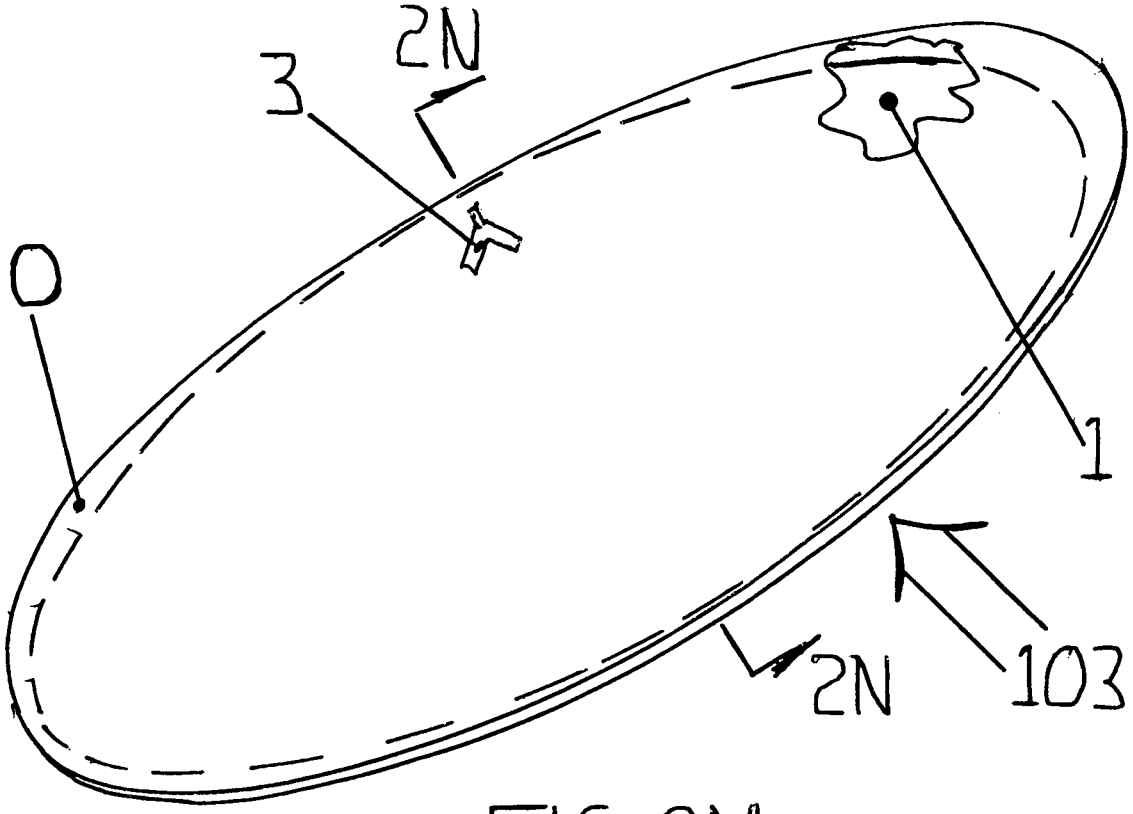
Figure 2N:
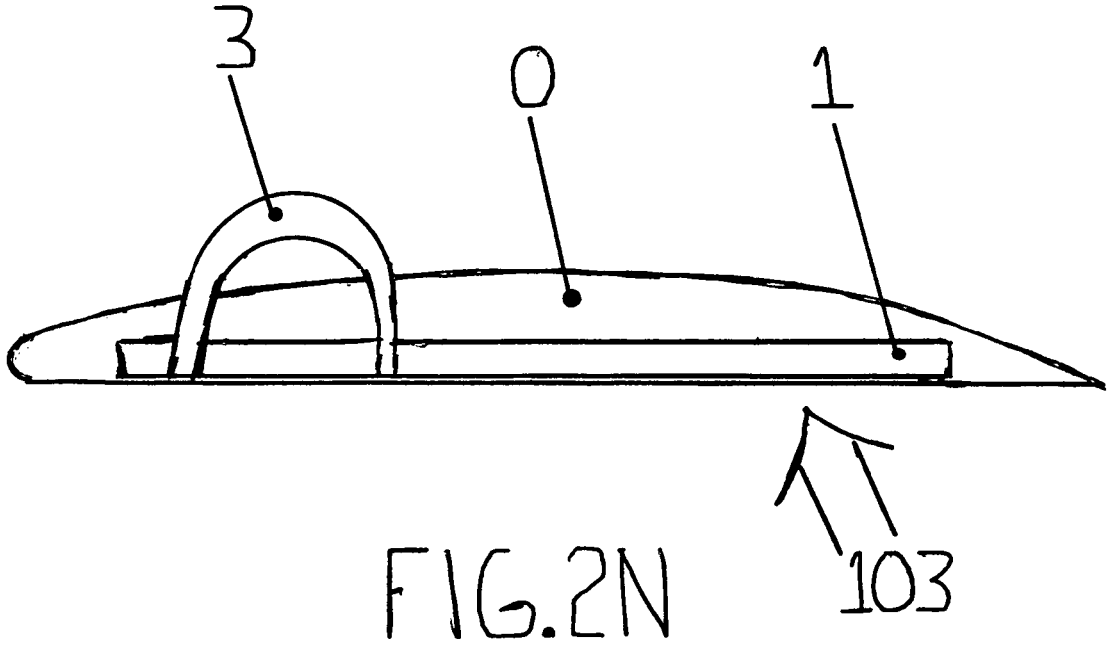

FIG. 2L: Isometric view of assembly 143, comprised of wing 1, surf wax 4 applied the wing 1 deck, and sandal-upper 3.

FIG. 2M: Isometric view of assembly 103, comprised of wing 1, foam-covering 0, and sandal-upper 3; foam-covering 0 completely covering and encompassing wing 1, and so, comprising an impact-absorbing safety device. In other embodiments, and without limitation here, foam-covering may be partial, substantial, or may entirely cover wings of the invention.

FIG. 2N: Section view of assembly 103 showing wing 1 encompassed and circumscribed by foam-covering 0, foam-covering 0 both providing buoyancy and impact-absorbing qualities, and sandal-upper 3 located proximate the leading edge (LE) of wing 1 and projection outwardly from the deck of wing 1.

Figure 2O:
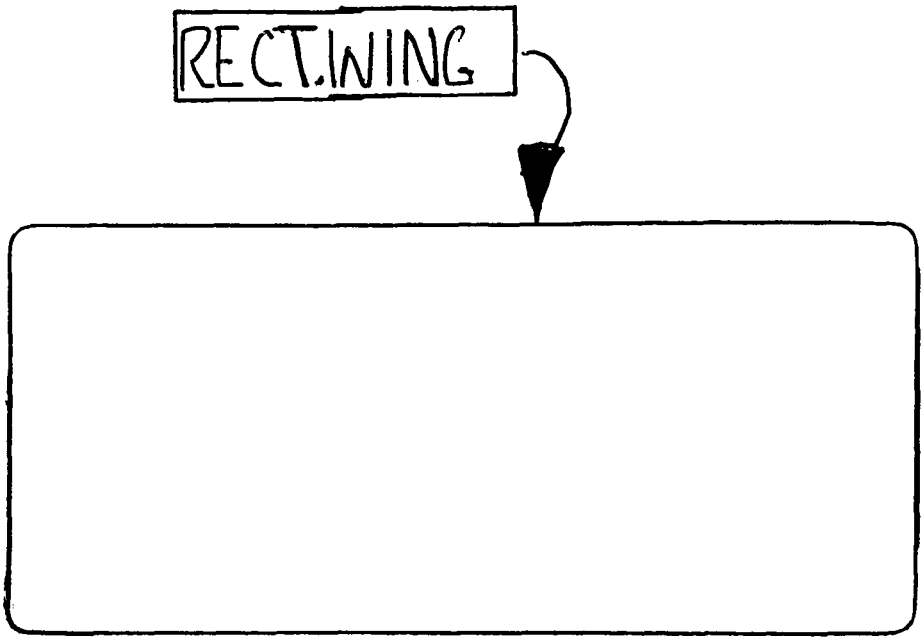

FIG. 2O: Planform view of a wing of rectangular shape, useful to the many aspects and embodiments of this disclosure.

Figure 2P:
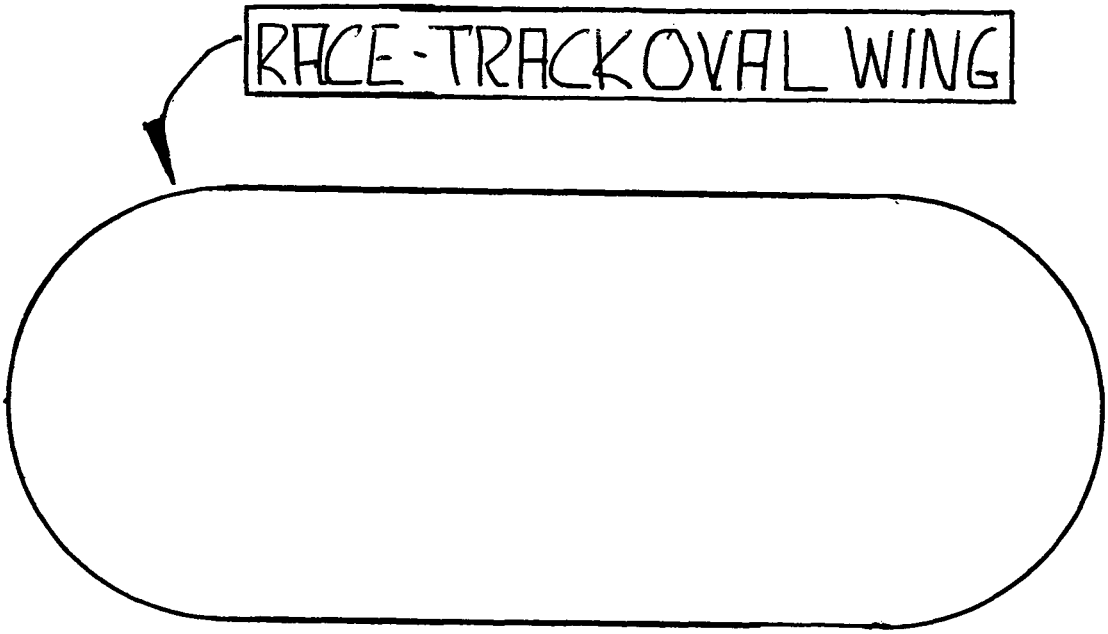

FIG. 2P: Planform view of a wing having a periphery of race-track oval shape, useful to the many aspects and embodiments of this disclosure.

Figure 2Q:
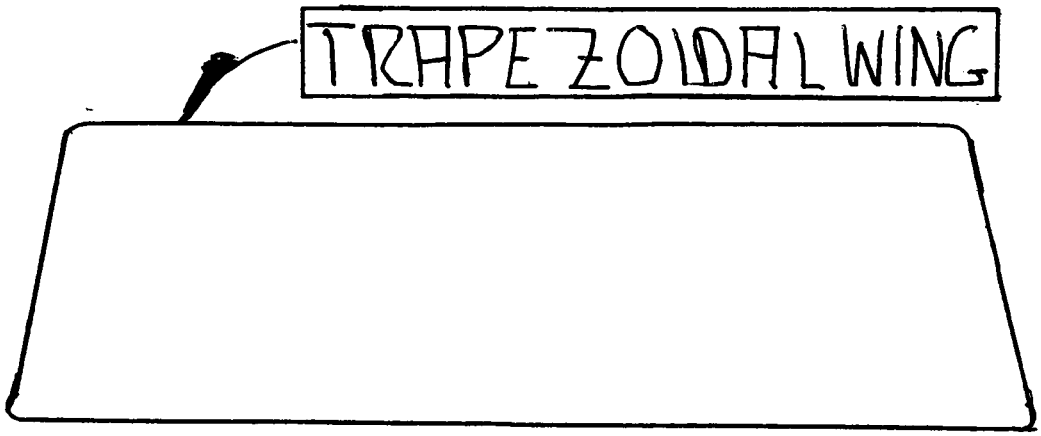

FIG. 2Q: Planform view of a wing of trapezoidal shape, another wing shape useful to the many aspects and embodiments of this disclosure.

Figure 2R:
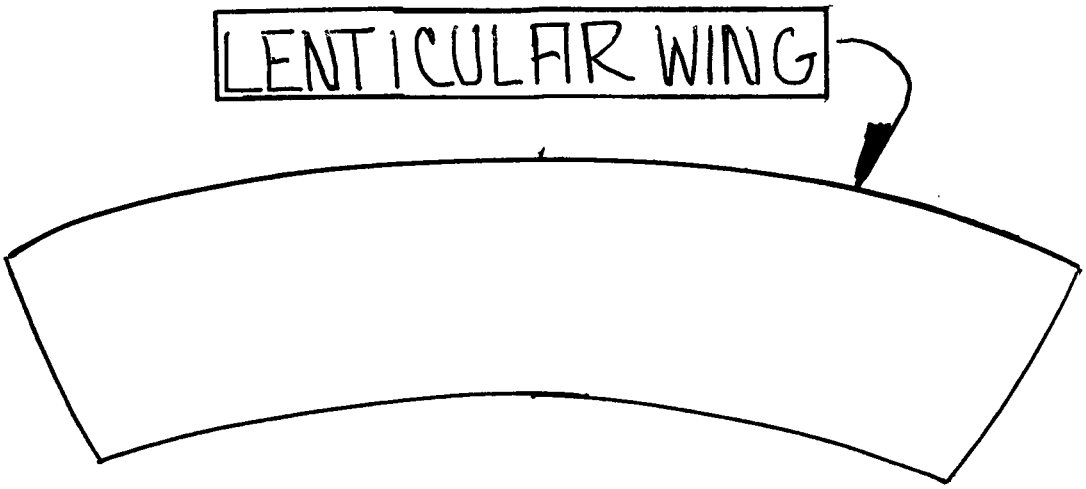

FIG. 2R: Planform view of a lenticular wing shape, the lenticular shape of wing being useful to the many aspects and embodiments of this disclosure.

Figure 2S:
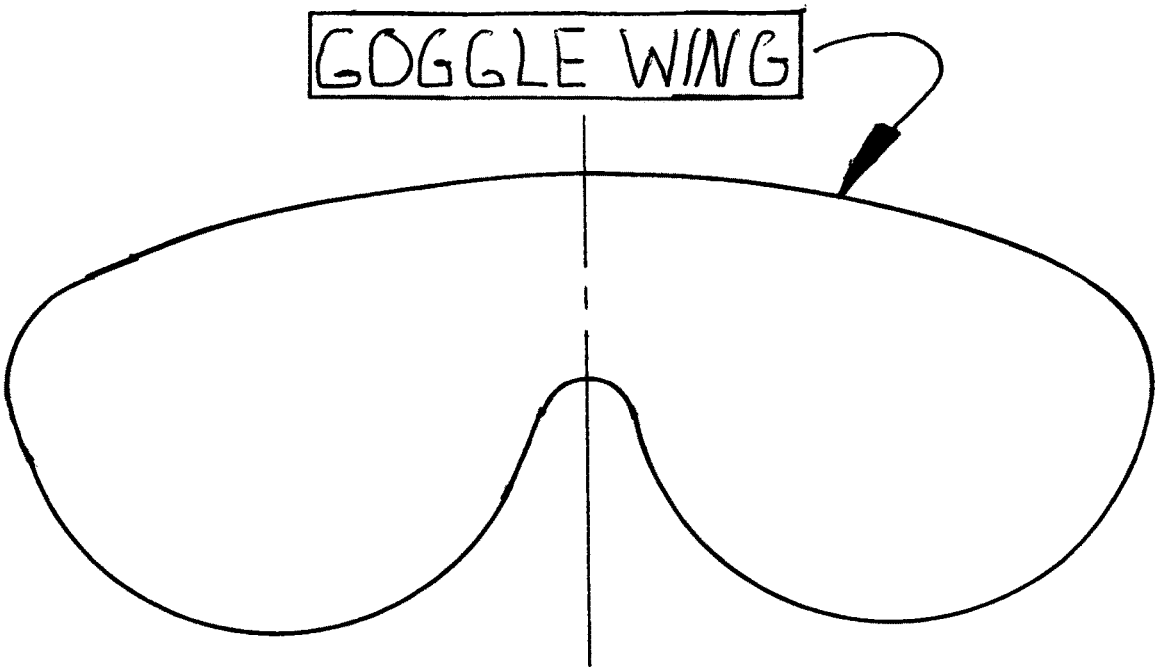

FIG. 2S: Planform view of a goggle-shaped wing, a goggle-shaped wing being useful to the many aspects and embodiments of this disclosure.

Figure 2T:
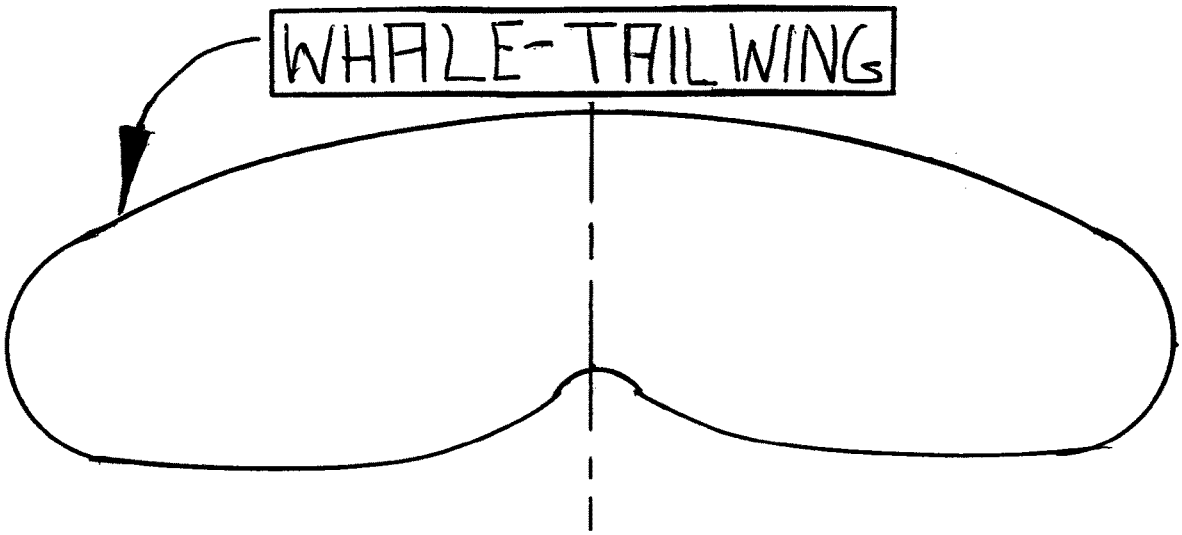

FIG. 2T: Planform view of a whale-tail wing shape, the whale-tail wing shape being useful to the many aspects and embodiments of this disclosure.

Figure 2U:
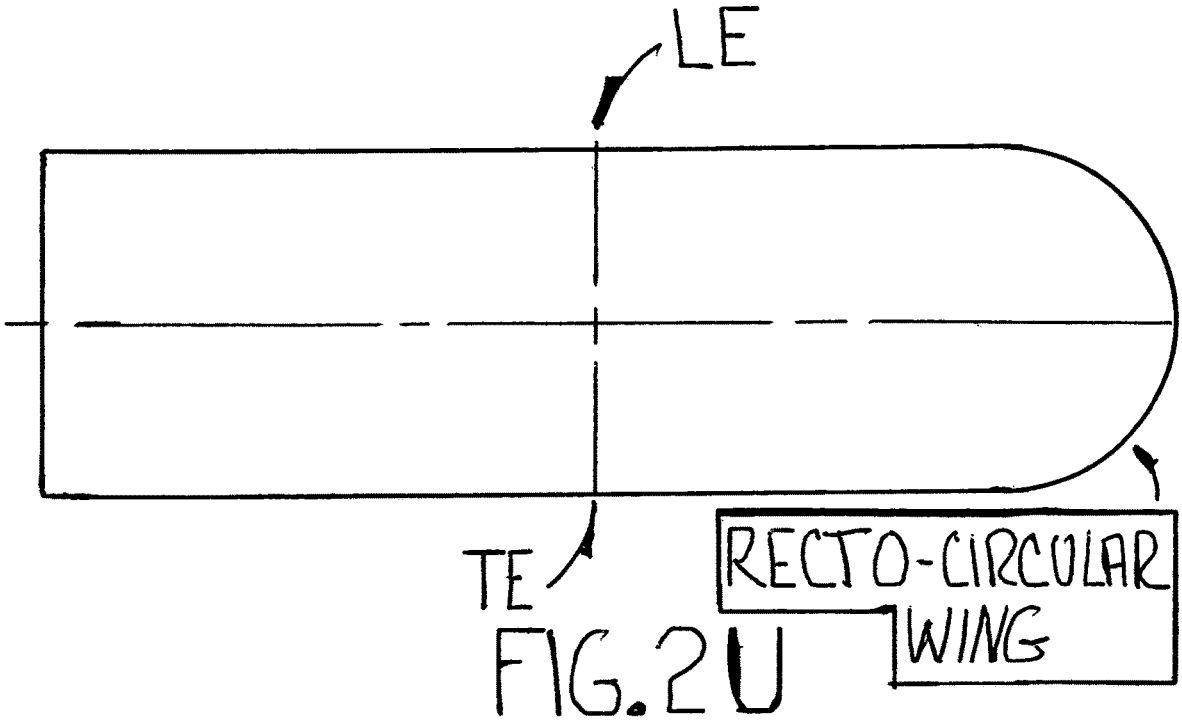

FIG. 2U: Planform view of a recto-circular wing, a rectangular wing with a rounded surfboard front portion, and a squared-off surfboard aft portion, this shape being useful for wave riding in a surfboard longitudinal direction while also, the wing still functions as a hydrofoil under heave and pitch by a rider travelling transverse the surfboard longitude, which is to say, hydro-foiling in a chordwise direction.

Figure 2V:
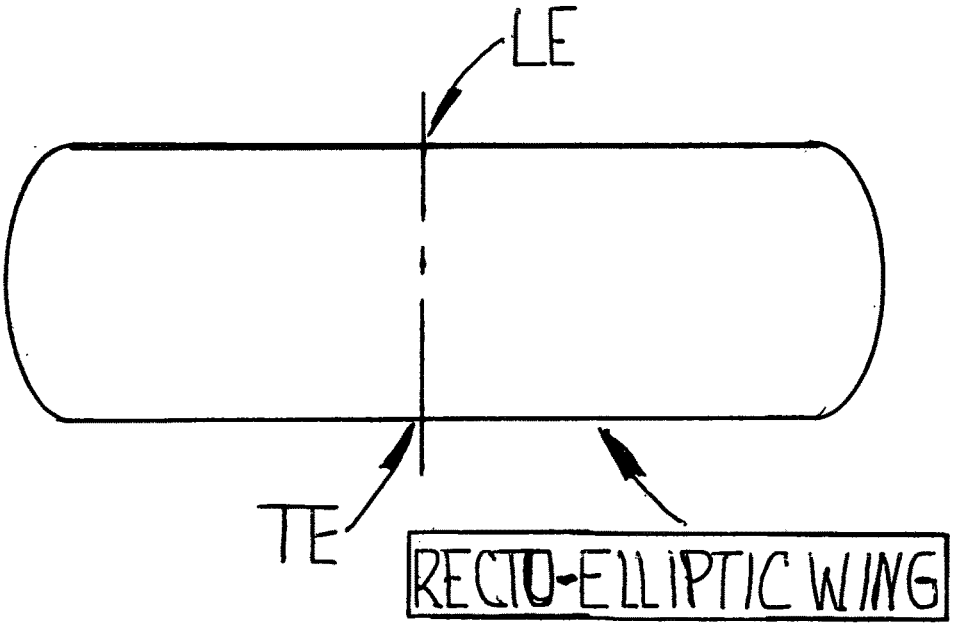

FIG. 2V: Planform view of a wing combining a rectangle in the main wing portion with elliptic wing-tips, referred to as a recto-elliptic wing.

Figure 3A:
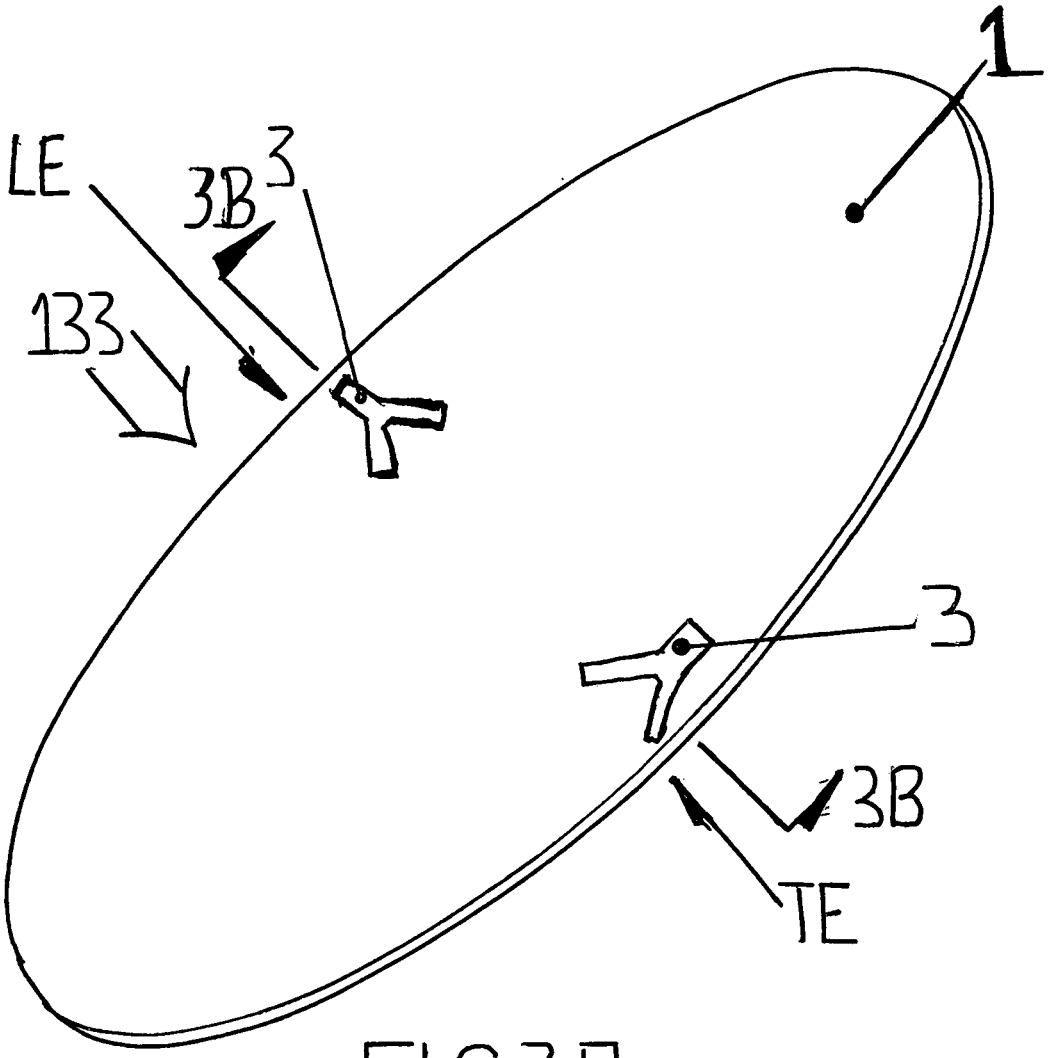

FIG. 3A: Isometric view of assembly 133 comprised of wing 1, first sandal-upper 3 proximate the leading edge (LE) of wing 1, and second sandal upper 3 proximate the trailing edge (TE) of wing 1.

Figure 3B:
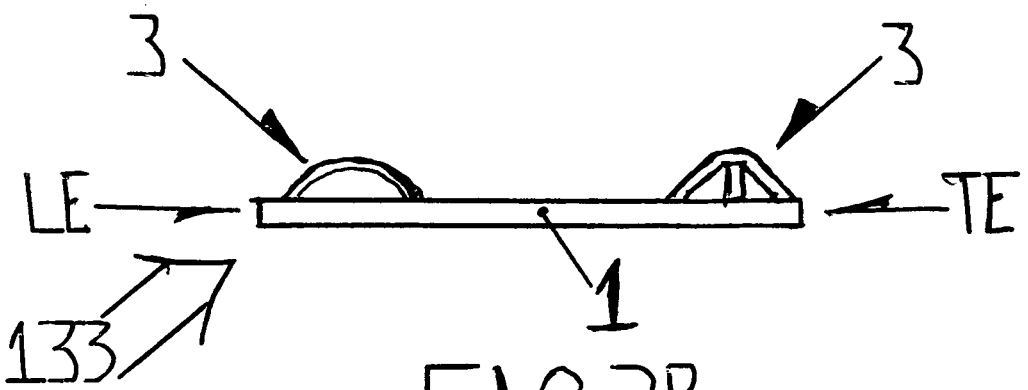

FIG. 3B: Section view of assembly 133 showing wing 1 and first sandal upper 3 proximate wing 1 leading edge (LE), and second sandal upper 3 proximate wing 1 trailing edge (TE).

Figure 3C:
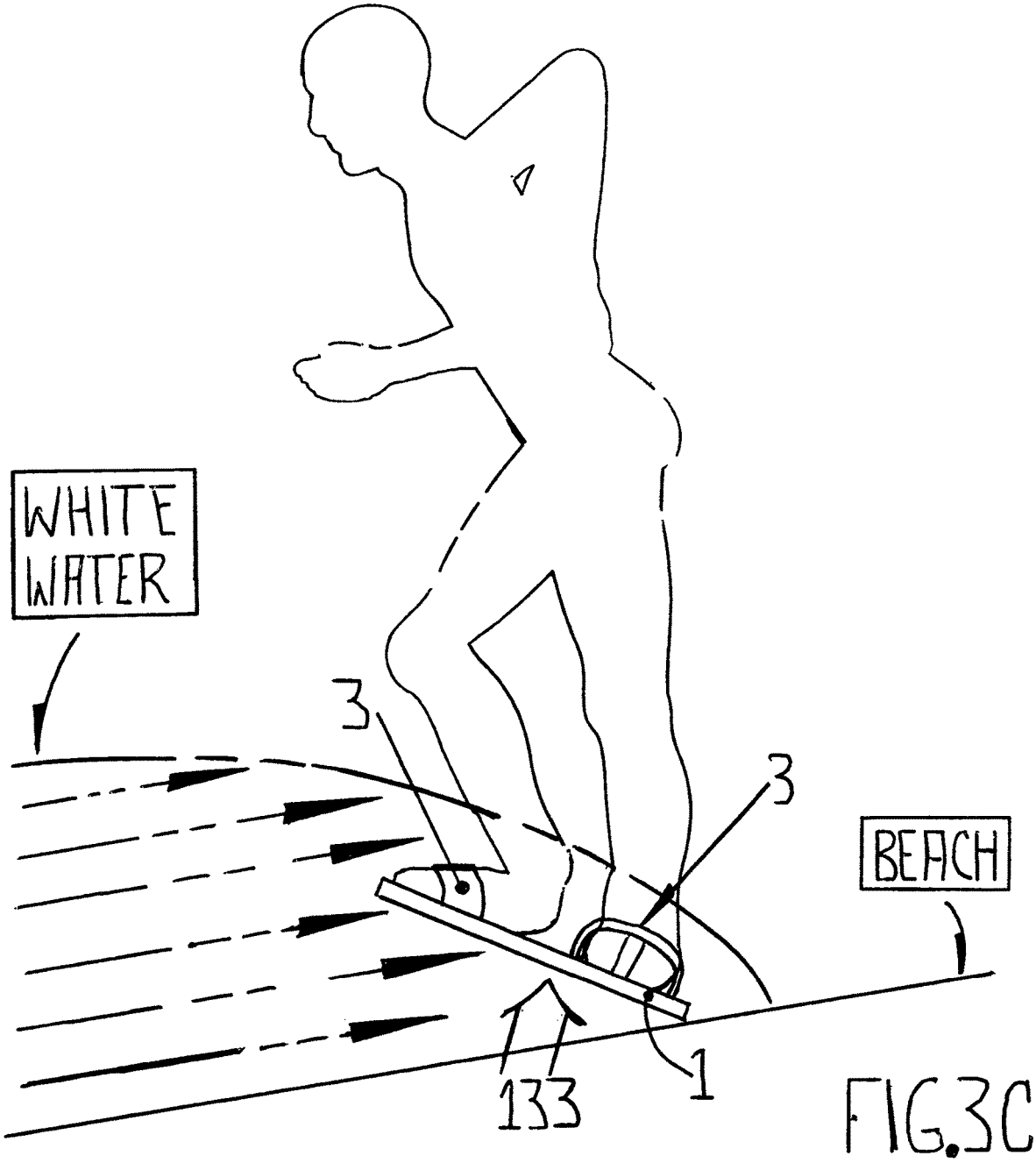

FIG. 3C: Section view of a rider (in phantom) standing with both feet upon the upper surface of the board assembly 133, and a whitewater wave surge inundating the wing and rolling under the wing as the rider presents the wing underside to the incoming wave surge, the rider and wing thereby being lifted vertically by the momentum of the surge from the beach This exemplifies the method of a whitewater-start, a method unique to this invention and disclosure.

Figure 4A:
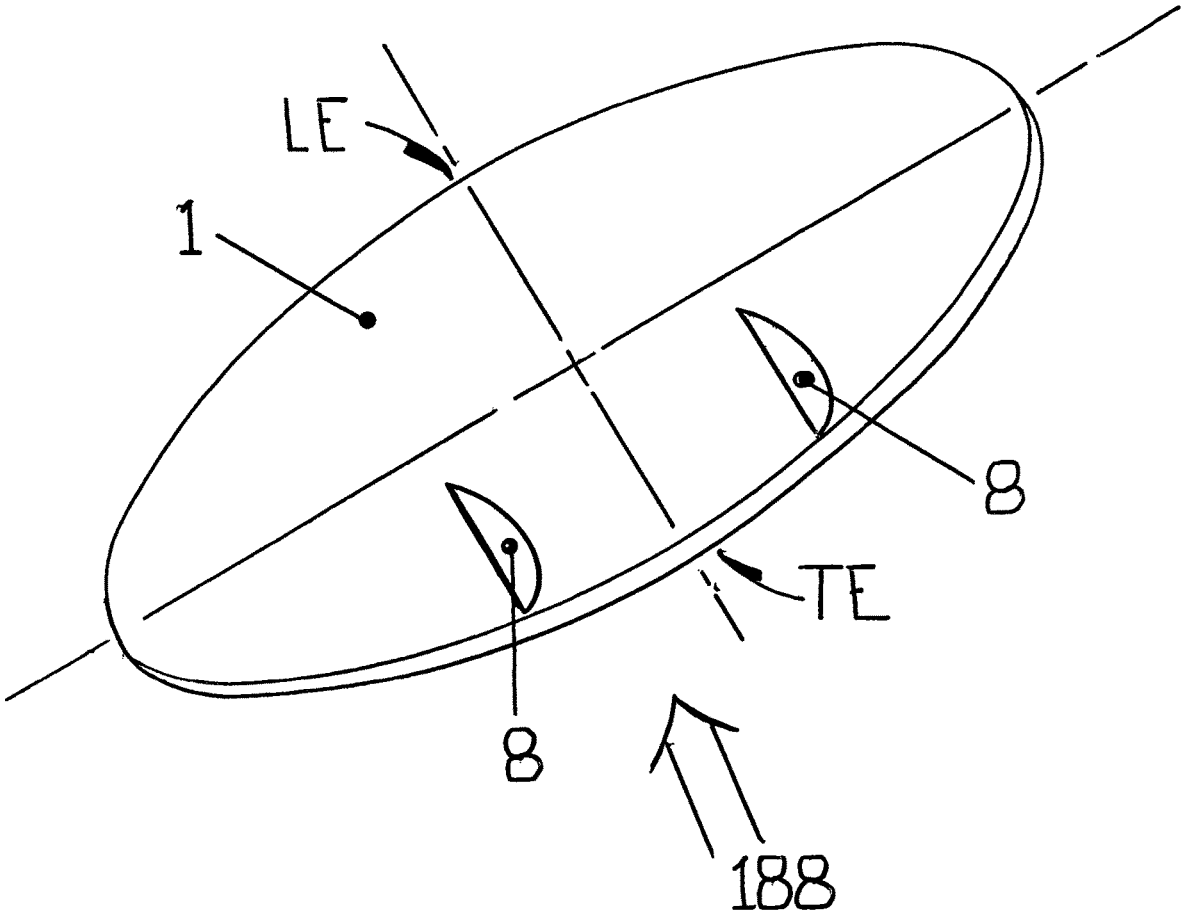

FIG. 4A: Isometric view of surfboard assembly 188 comprised of wing 1, and stabilizing fins 8, stabilizing fins 8 fixedly attaching wing 1 and projecting outwardly from the lower wing surface. Fins 8 attaching proximate the trailing edge of wing 1, and proximate a central portion of the wing-span of wing 1, fins 8 being substantially parallel each other and oriented substantially transverse the wing-span of wing 1, which is to say substantially parallel a chordal direction of wing 1, thereby giving yaw-stability to surfboard assembly 188 as it tracks thru water in a chord-wise direction, whether under human power or wave power.

CONCLUSION, RAMIFICATIONS, AND SCOPE

The buoyant wing of this disclosure is vastly simpler than the prior art of human powered watercraft. The unobvious and novel combination of a buoyant wing and foot constraint make this hydrofoil device which explicitly applies skim boards, surfboards, body boards, and other watercraft without limitation, quite thrilling to ride and easy to learn to ride. The novelty of combining a forward foot-constraining device proximate the wing leading edge un-obviously yields the ability to up-heave the wing from below the surface of the water so to enable continuous cycling in upheave and down-heave, up-pitch and down-pitch to achieve a chord-wise velocity in water by the rider and wing, the system exemplifying elegance of design, and achieving by simplicity and minimal size, economies which will resound within the market of watermen and women. Many derivative embodiments will come to mind of those skilled in the art and having the benefit of these teachings. Recapitulating, the planform shape of the wing may be of many geometric forms, for example but without limitation, the wing planforms may not only be elliptic, but may be rectangular, trapezoidal, race-track oval, lenticular, and whale-tail shaped, to name but a few. The chordal wing sections in this disclosure have been described as flat atop and on bottom of the wing in some aspects, and in other aspects are described as flat on bottom and curved atop the wing and, in still other aspects as being selected from conventional wing sections of between NACA-0001 thru NACA-0020 wing chord sections. Described foot-constraining devices include foot-straps, sandal-uppers, conventional water-ski bindings, surfboard traction-pads, self-adhesive frictional step-tread, and, self-adhesive frictional surf wax applied the deck of the wing. Each foot-constraining device described in the foregoing may be combined with the others here or used in-lieu of any other foot-constraint resulting in many different embodiments which fall within the spirit of the invention. Therefore, the invention should not be narrowly construed to any specific aspect disclosed, but rather, broadly and in their many combinations, and, by the appended claims and their legal equivalents.

What is claimed is:

1. A wing for riding on water comprising a wing-span and a wing minor chord and a wing-thickness, and said wing having a deck upon which a rider may stand and sit and lie, said deck comprising an upper surface of said wing, and said wing having a foot-constraining strap attached to said wing at the front of the deck, and said foot-constraining device further being attached to said wing proximate a wing span center portion of said wing along the wing minor chord, and proximate a leading edge of said wing, and said foot-constraining strap being oriented substantially transverse said wing-span of said wing, the deck having a location for placing a second foot of a rider along the wing minor chord approximate the rear of the deck, and said wing is substantially of a material having a buoyancy in water, and the wing is buoyant in water, the wing having a lower surface area of at least 1 foot squared per 20 pounds of rider weight wherein the wing further comprises at least one fin on an underside of the wing opposite the deck, the deck being free of rigid fins and other rigid projections.

2. The wing according to claim 1 wherein the wing-span of the wing is greater than 2 feet and is as much as 4 feet.

3. The wing according to claim 1 wherein the wing-span of the wing is greater than 4 feet and the minor chord length is between 10 and 30 inches.

4. The wing according to claim 1 wherein the wing-span of the wing is greater than 5 feet and is as much as 6 feet.

5. The wing according to claim 1 wherein the wing-span of the wing is greater than 6 feet and is as much as 7 feet.

6. The wing according to claim 1 wherein the wing-span of the wing is greater than 7 feet and is as much as 8 feet.

7. The wing according to claim 1 wherein the wing-span of the wing is greater than 8 feet and is as much as 9 feet.

8. The wing according to claim 1 wherein the wing-span of the wing is greater than 9 feet and is as much as 10 feet.

9. The wing according to claim 1 wherein at least a portion of the wing has a wing-chord greater than 10 inches and is as much as 20 inches.

10. The wing according to claim 1 wherein at least a portion of the wing has a wing-chord greater than 20 inches and is as much as 30 inches.

11. The wing according to claim 1 wherein at least a portion of the wing is of a thickness greater than ⅛ inch and is as much as 1 inch.

12. The wing according to claim 1 wherein at least a portion of the wing is of a thickness greater than 1 inch and is as much as 4 inches.

13. The wing according to claim 1 wherein the wing is comprised substantially of a plywood sheet, and the deck surface of the wing is an upper surface of said plywood sheet, and a lower surface of the wing is a lower surface of the plywood sheet and is spaced apart from said upper surface of the plywood sheet by a thickness of the plywood sheet, and further wherein said lower surface of the wing is substantially flat, and the deck surface of the wing is substantially flat.

14. The wing according to claim 1 wherein the wing is comprised substantially of a planform shape chosen from among a list comprised of: elliptic, rectangular, race-track oval, recto-elliptic, lenticular, whale-tail, goggle, recto-circular, and trapezoidal shaped planforms.

15. The wing according to claim 1 wherein the wing is comprised of wing chord sections selected from among a list comprised of: NACA-0001 thru NACA-0020 sections.

16. The wing according to claim 1 wherein the wing is substantially covered by a polymeric foam.

17. The wing according to claim 1 wherein the foot-constraining strap is selected from among a list comprised of: an upper-of-a sandal, a foot-strap, a surfboard traction-pad, a step-tread, a conventional water-ski binding, and, surf wax.

18. The wing according to claim 1 wherein a second foot constraining device attaches the wing, said second foot constraining device attaching the wing proximate a trailing edge of the wing and projecting outwardly from the deck of the wing.

19. A method of using the wing of claim 1, whereby, a rider may stand upon the deck of the wing and may heave and pitch the wing in a body of water and achieve a velocity thru said body of water, and may further achieve a yaw stability of the wing in the body of water via the at least one stabilizing fin.

20. In combination, a skim board for skim boarding and surfing upon bodies of water, and a foot-constraining strap, said board having a major axis of at least 4 feet along the breadth and a minor axis between 10 and 30 inches, said foot-constraining strap attaching said skim board at a deck of the skim board along the minor axis, and the foot-constraining strap further being proximate a leading edge of the skim board, and the foot-constraining strap having a predetermined orientation with respect to a breadth of the skim board the skim board further comprising at least one fin on an underside of the skimboard opposite the deck, the deck being free of rigid fins and other rigid projections; whereby a foot of a rider of the skim board when said foot of said rider is held by the foot-constraining strap is oriented from said edge of the skim board toward a central portion of the skim board; and further whereby, the rider of the skim board may upheave upon the foot-constraining strap and lift the skim board from a predetermined depth beneath a surface of water to a higher elevation with respect to said surface of said water; and further whereby the rider may continuously cycle the skim board in upheave and down-heave in the water to achieve a velocity in the water, the rear foot of the rider being placed along the minor axis near the trailing edge of the board.

* * * * *